US007864172B2

(12) United States Patent
Miyake et al.

(10) Patent No.: US 7,864,172 B2
(45) Date of Patent: Jan. 4, 2011

(54) CATHODE POTENTIAL CONTROLLER, SELF LIGHT EMISSION DISPLAY DEVICE, ELECTRONIC APPARATUS, AND CATHODE POTENTIAL CONTROLLING METHOD

(75) Inventors: Hidekazu Miyake, Kanagawa (JP); Mitsuru Tada, Kanagawa (JP); Tomoaki Handa, Tokyo (JP); Atsushi Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 408 days.

(21) Appl. No.: 12/153,554

(22) Filed: May 21, 2008

(65) Prior Publication Data

US 2008/0297055 A1 Dec. 4, 2008

(30) Foreign Application Priority Data

May 30, 2007 (JP) ..... 2007-144186

(51) Int. Cl.
*G09F 5/00* (2006.01)
*G09G 3/10* (2006.01)

(52) U.S. Cl. ..... 345/212; 345/214; 345/77; 315/169.2; 315/169.3

(58) Field of Classification Search ..... 345/76, 345/77, 82, 84, 204, 212, 214; 315/169.2, 315/169.3

See application file for complete search history.

(56) References Cited

U.S. PATENT DOCUMENTS

| | | | | |
|---|---|---|---|---|
| 6,995,519 | B2 * | 2/2006 | Arnold et al. | 315/169.3 |
| 2005/0068270 | A1 * | 3/2005 | Awakura et al. | 345/76 |
| 2006/0055631 | A1 * | 3/2006 | Yoshida | 345/46 |
| 2009/0244051 | A1 * | 10/2009 | Hayafuji et al. | 345/212 |

FOREIGN PATENT DOCUMENTS

| | | |
|---|---|---|
| JP | 2002-229513 | 8/2002 |
| JP | 2002-278514 | 9/2002 |
| JP | 2003-228324 | 8/2003 |
| JP | 2004-302289 | 10/2004 |
| JP | 2005-189696 A | 7/2005 |
| JP | 2006-011388 | 1/2006 |
| JP | 2006-065319 | 3/2006 |
| JP | 2006-251632 A | 9/2006 |

* cited by examiner

*Primary Examiner*—Thuy Vinh Tran
(74) *Attorney, Agent, or Firm*—Rader, Fishman & Grauer PLLC

(57) ABSTRACT

A cathode potential controller for controlling a common cathode potential applied to a self light emission type display panel in which an emission state of each of pixels is driven and controlled in accordance with an active matrix drive system, the cathode potential controller including: a self light emitting element; a constant current source; an electrode-to-electrode voltage measuring portion; a cathode potential determining portion; and a cathode potential applying portion.

15 Claims, 21 Drawing Sheets

CATHODE POTENTIAL CONTROLLER, SELF LIGHT EMISSION DISPLAY DEVICE, ELECTRONIC APPARATUS, AND CATHODE POTENTIAL CONTROLLING METHOD

CROSS REFERENCES TO RELATED APPLICATIONS

The present invention contains subject matter related to Japanese Patent Application JP 2007-144186 filed in the Japan Patent Office on May 30, 2007, the entire contents of which being incorporated herein by reference.

BACKGROUND OF THE INVENTION

1. Field of the Invention

The present invention relates to a technique for correcting a fluctuation of a driving current due to the temperature characteristics of each of self light emitting elements constituting pixels of a self light emission display panel, respectively. In particular, the invention relates to a cathode potential controller and a cathode potential controlling method each of which is capable of correcting an influence which temperature characteristics of a self light emitting element exerts on a bootstrap operation of a drive transistor by variably controlling a cathode potential of the self light emitting element, a self light emission display device, and an electronic apparatus.

2. Description of the Related Art

At present, the various kinds of flat panel display devices are put to practical use. An organic Electro Luminescence (EL) display panel in which organic EL elements are disposed in a matrix within a display region is known as one of them. The organic EL display panel is not only readily thinned because of its lightness, but also is excellent in the moving image display characteristics because of its high response speed.

However, the following problem is pointed out. That is to say, when a driving current changes depending on an environmental temperature or a temperature change following exothermic heat of the organic EL display panel itself, an emission luminance changes in terms of the characteristics common to the organic EL display panels in each of which the emission luminance changes depending on the magnitude of the driving current.

Actually, the current vs. voltage characteristics of the organic EL element have the temperature characteristics. Therefore, even when a drive transistor is driven with the same voltage, the magnitude of the driving current fluctuates depending on the temperature. Thus, the technique for reducing the luminance change due to the temperature dependency characteristics is desired to be developed.

SUMMARY OF THE INVENTION

The technique for variably controlling a power source voltage, on a high potential side, which is applied to a pixel portion (corresponding to an effective display region described in this specification) in accordance with a voltage developed at an anode electrode of a monitoring element when a constant current is caused to flow through the monitoring element is disclosed in Japanese Patent Laid-Open No. 2006-11388 (hereinafter referred to as Patent Document 1).

That is to say, the technique for variably controlling a potential difference between the (variably controlled) high potential side power source and the (fixed) low potential side power source is disclosed in Patent Document 1. However, with this correcting technique disclosed therein, such an influence that the luminance change is caused due to the fluctuation, of a driving voltage (a gate to source voltage $V_{gs}$) of a drive transistor, following a bootstrap operation is not taken into consideration at all.

In the light of the foregoing, it is therefore desire to provide a cathode potential controller and a cathode potential controlling method each of which is capable of correcting an influence which temperature characteristics of a self light emitting element exerts on a bootstrap operation of a drive transistor by variably controlling a cathode potential of the self light emitting element, a self light emission display device, and an electronic apparatus.

In addition, it is also desire to provide correcting techniques for the case where a self light emitting element for voltage measurement is used, and the case where a self light emitting element for display and measurement, respectively.

(A) Correction Technique 1

In order to attain the desire described above, according to an embodiment of the present invention, there is provided a cathode potential controller for controlling a common cathode potential applied to a self light emission type display panel in which an emission state of each of pixels is driven and controlled in accordance with an active matrix drive system, the cathode potential controller including:

(a) a self light emitting element for voltage measurement disposed outside an effective display region;

(b) a constant current source for supplying a constant current to the self light emitting element for voltage measurement;

(c) an electrode-to-electrode voltage measuring portion for measuring a potential developed at an anode electrode of the self light emitting element for voltage measurement, and measuring an electrode to electrode voltage of the self light emitting element for voltage measurement;

(d) a cathode potential determining portion for determining a cathode potential value by using a difference value between a measured value of the electrode to electrode voltage of the self light emitting element for voltage measurement, and a reference voltage value as a correction value; and (e) a cathode potential applying portion for applying a cathode potential corresponding to the determined cathode potential value to a common cathode electrode of the self light emission type display panel.

(B) Correction Technique 2

According to another embodiment of the present invention, there is provided a cathode potential controller for controlling a common cathode potential applied to a self light emission type display panel in which an emission state of each of pixels is driven and controlled in accordance with an active matrix drive system, the cathode potential controller including:

(a) a constant current source for voltage measurement disposed outside an effective display region for supplying a constant current to a self light emitting element for display and measurement constituting a specific pixel, the self light emitting element for display and measurement being disposed inside the effective display region;

(b) an electrode-to-electrode voltage measuring portion for measuring a potential developed at an anode electrode of the self light emitting element for display and measurement constituting the specific pixel in a phase of measuring an electrode to electrode voltage of the self light emitting element for display and measurement, and measuring the electrode to electrode voltage of the self light emitting element for display and measurement;

(c) a cathode potential determining portion for determining a cathode potential value by using a difference value between a measured value of the electrode to electrode voltage of the self light emitting element for display and measurement, and a reference voltage value as a correction value; and (d) a cathode potential applying portion for applying a cathode potential corresponding to the determined cathode potential value to a common cathode electrode of the self light emission type display panel.

According to the present embodiment, the cathode potential value of the organic EL element for display and measurement is controlled in accordance with the difference value between the measured value of the electrode to electrode voltage of the self light emitting element for display and measurement, and the reference voltage value (the electrode to electrode voltage of the self light emitting element for display and measurement at a room temperature).

For example, when a temperature is lower than the room temperature, the electrode to electrode voltage of the self light emitting element for display and measurement moves to lower voltages with respect to the reference voltage value. In this case, therefore, the control is carried out such that the cathode potential value moves to higher voltages by the difference value.

On the other hand, for example, when the temperature is higher than the room temperature, the electrode to electrode voltage of the self light emitting element for display and measurement moves to higher voltages with respect to the reference voltage value. In this case, therefore, the control is carried out such that the cathode potential value is reduced by the difference value.

As a result, even when the temperature changes, the driving voltage for the drive transistor after completion of the bootstrap operation is controlled so as to become the same state as that at the room temperature. That is to say, the control can be carried out such that the temperature change in current vs. voltage characteristics of the self light emitting element does not appear in the form of a change in driving current.

DETAILED DESCRIPTION OF THE PREFERRED EMBODIMENTS

Hereinafter, a detailed description will be given with respect to the case where the present invention is applied to cathode potential control for an active matrix drive type organic EL display panel.

It is noted that the well-known or known technique in this technical field is applied to any of portions which are especially illustrated or described in this specification.

(A) Principles of Generation of Temperature Characteristics of Driving Current (a) Principles of Fluctuation of Driving Current Due to Temperature Characteristics of Organic EL Element Firstly, a mechanism in which a driving current for a drive transistor fluctuates due to the temperature characteristics of an organic EL element will now be described by giving a current control type organic EL display panel as an example.

Figure 1:
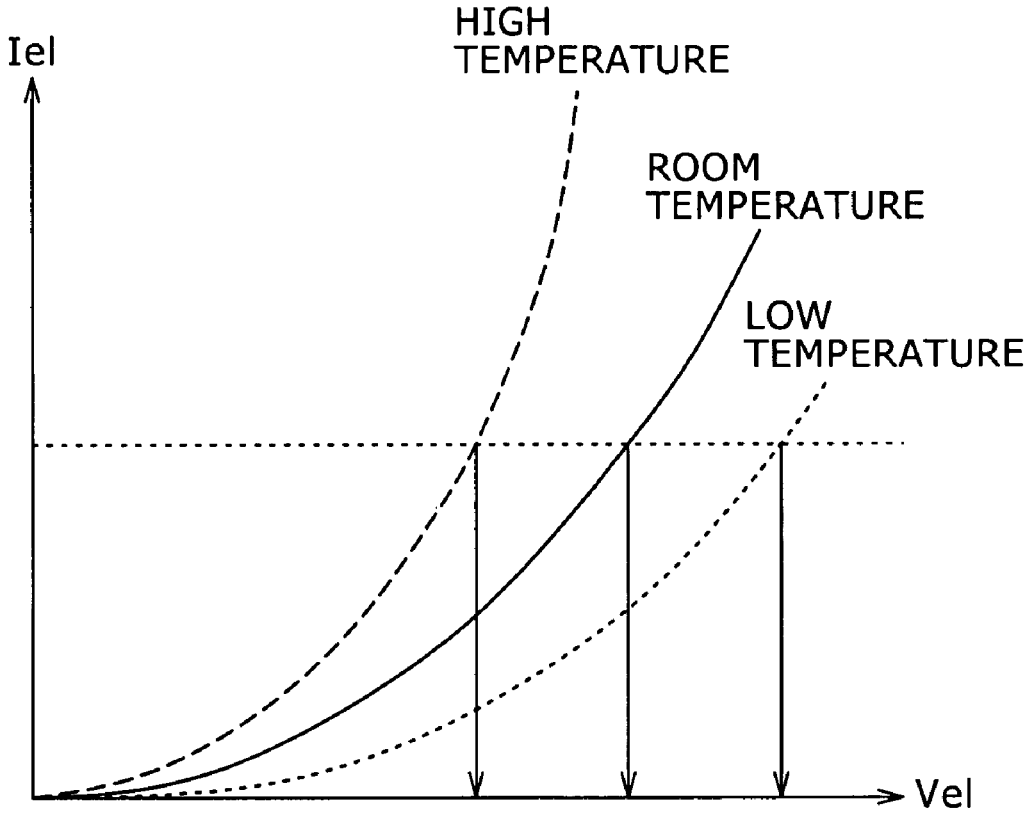
FIG. 1 is a graphical representation explaining temperature characteristics which current vs. voltage characteristics of an organic EL element generally have.

FIG. 1 shows the temperature characteristics which current vs. voltage characteristics of an organic EL element generally have. As shown in FIG. 1, when a constant current is caused to flow through the organic EL element, an electrode to electrode voltage $V_{el}$ of the organic EL element falls with a rise in a temperature.

Figure 2:
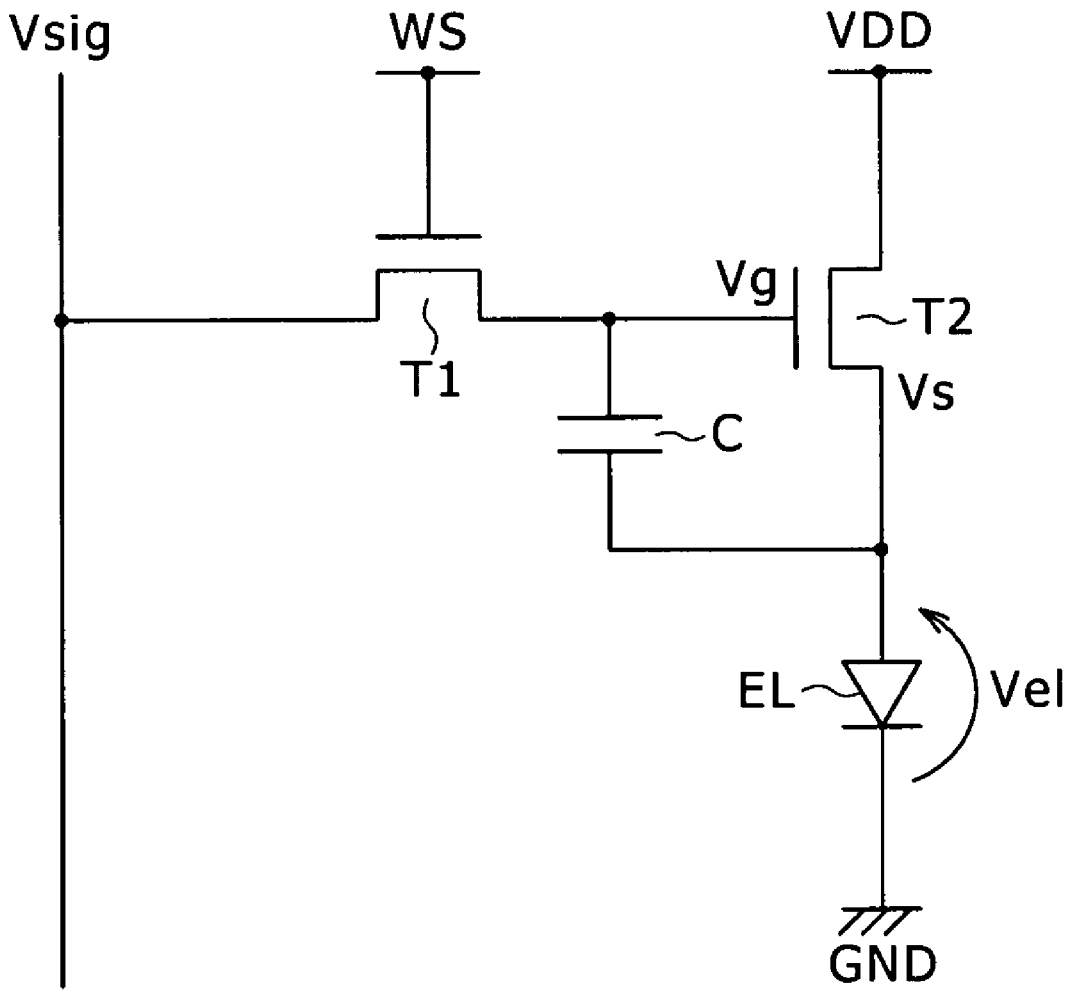
FIG. 2 is a circuit diagram showing an example of a pixel circuit composed of two N-channel thin film transistors.
Figure 3:
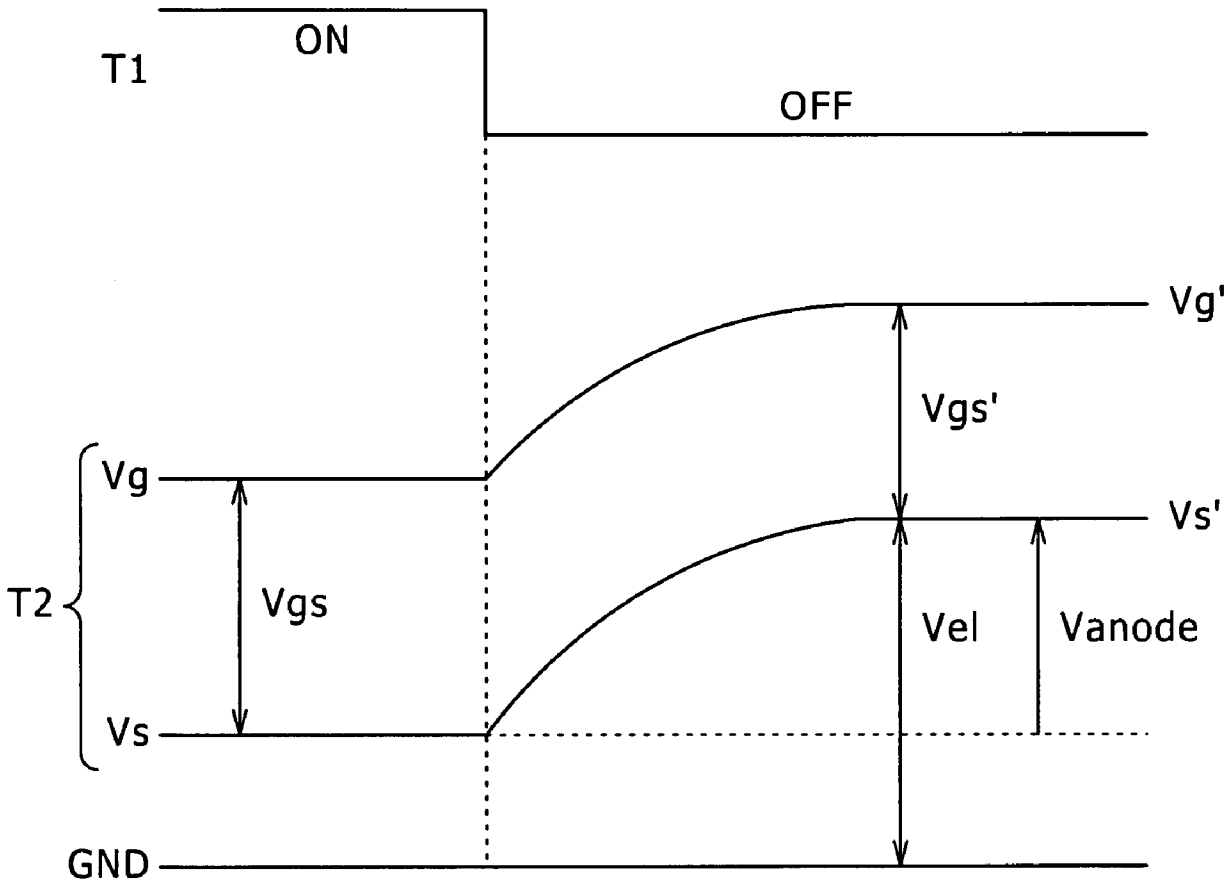
FIG. 3 is a timing chart explaining a change in gate to source voltage of a drive transistor accompanying a bootstrap operation.

Hereinafter, a bootstrap operation of a drive transistor shown in FIG. 3 will be described with reference to a circuit diagram of a pixel circuit shown in FIG. 2. By the way, FIG. 2 shows the case where a pixel circuit 2 is composed of two N-channel thin film transistors T1 and T2.

Of the two N-channel thin film transistors T1 and T2, the N-channel thin film transistor T1 is a transistor for controlling the operation for writing pixel data to a storage capacitor C. On the other hand, the N-channel thin film transistor T2 is a transistor for supplying a driving current $I_d$ having a magnitude corresponding to a voltage $V_{gs}$ held in the storage capacitor C to the organic EL element. That N-channel thin film transistor T2 corresponds to a drive transistor as an object of the description given herein.

The operation of the pixel circuit makes progress as follows. Firstly, the N-channel thin film transistor T1 is controlled so as to become an ON state. As a result, the pixel circuit is connected to a signal line $V_{sig}$. At this time, the charges corresponding to a signal potential $V_{data}$ applied to the signal line $V_{sig}$ are accumulated in the storage capacitor C. It is noted that in a phase of writing the signal potential $V_{data}$, a power source voltage VDD is controlled so as to become a grounding potential.

When the operation for writing the signal potential $V_{data}$ is completed, the N-channel thin film transistor T1 is controlled so as to be turned OFF, and at the same time, the power source voltage VDD is controlled so as to become a driving voltage (positive power source voltage). A driving current corresponding to a gate to source voltage $V_{gs}$ (a voltage held in the storage capacitor C) in a moment when the N-channel thin film transistor T1 is controlled so as to be turned OFF starts to be caused to flow through the drive transistor T2 along with that control operation for the power source voltage VDD.

At this time, a voltage (electrode to electrode voltage) $V_{el}$ corresponding to a magnitude of the driving current is developed across the electrodes of the organic EL element. The magnitude of the electrode to electrode voltage $V_{el}$ fluctuates depending on the temperature characteristics, though. A rise amount when a source potential $V_s$ changes to $V_s'$ owing to the electrode to electrode voltage $V_{el}$ is expressed by $V_{anode}$. At the same time, the gate potential $V_g$ for the drive transistor T2 rises to $V_g'$.

An operation in which each of the source potential $V_s$ and the gate potential $V_g$ changes along with the supply of the driving current is called a bootstrap operation. As a result, a value of the driving current for the drive transistor T2 changes to a value corresponding to the gate to source voltage $V_{gs}'$ after completion of that change.

It is noted that a relationship expressed by the following Expression (1) is recognized between the gate to source voltage $V_{gs}'$ after completion of the bootstrap operation and the gate to source voltage $V_{gs}$ before completion of the bootstrap operation:

$$V_{gs}'=V_{gs}-(1-G_b)\times V_{anode} \quad (1)$$

Where a value of $G_b$ is a bootstrap gain which is equal to or smaller than 1.0.

Figure 4:
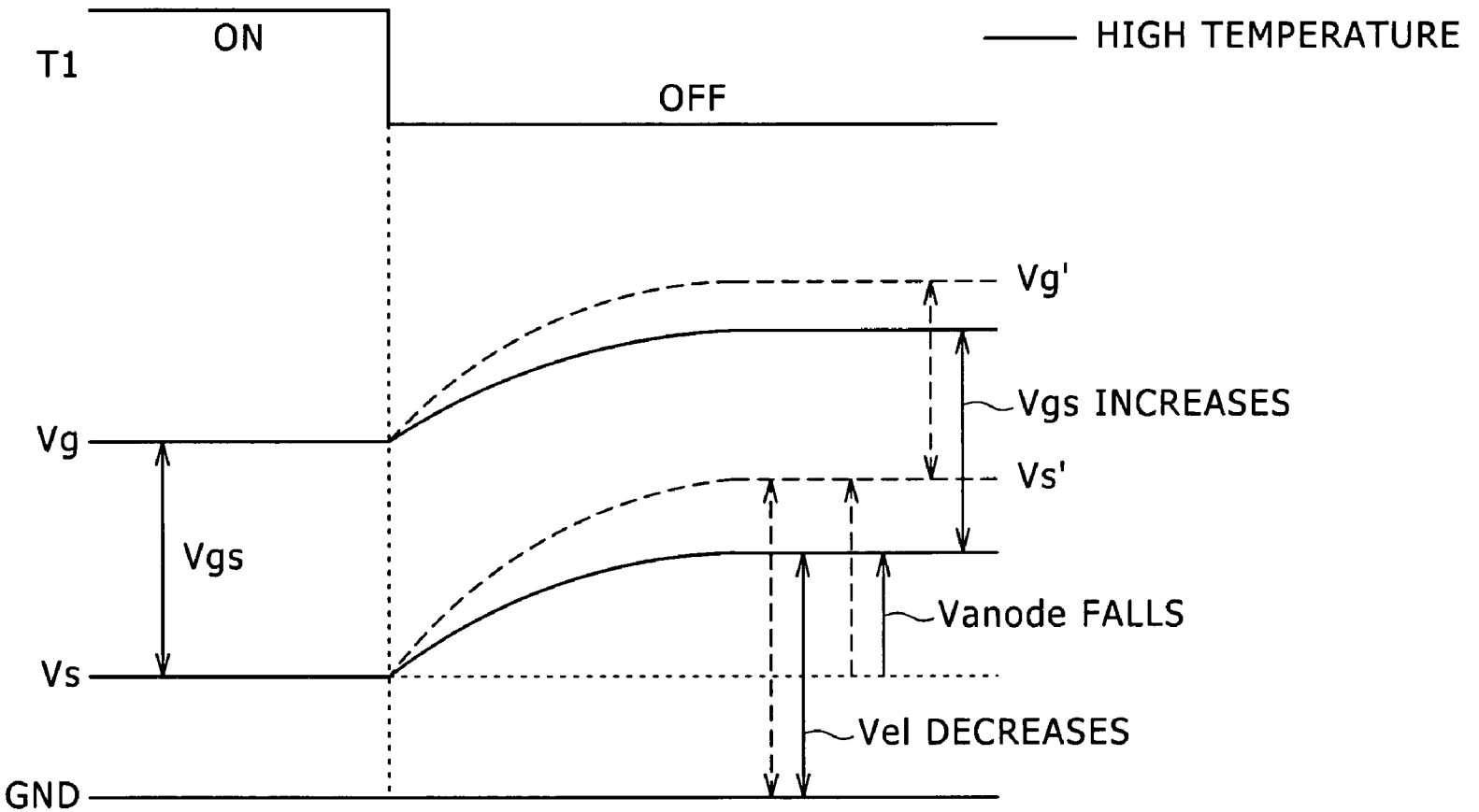
FIG. 4 is a timing chart explaining temperature characteristics of the gate to source voltage of the drive transistor accompanying the bootstrap operation.

FIG. 4 shows a temperature change in the bootstrap operation of the organic EL element. In the figure, an operation at a room temperature is indicated by a fine broken line, and an operation at a high temperature is indicated by a heavy solid line.

The electrode to electrode voltage $V_{el}$ of the organic EL element changes to decrease with the rise in the driving temperature. Along with this change, $V_{anode}$ regulating a rise amount of source potential $V_s$ following the bootstrap operation further falls than that at the room temperature.

This means that a term of $(1-G_b)\times V_{anode}$ in Expression (1) decreases. As a result, the gate to source voltage $V_{gs}'$ increases. When the gate to source voltage $V_{gs}'$ becomes larger than that at the room temperature, an amount of driving current naturally further increases than that at the room temperature.

On the other hand, when the driving temperature is lower than at the room temperature, the electrode to electrode voltage $V_{el}$ of the organic EL element increases. Also, $V_{anode}$ giving a rise amount of source potential $V_s$ following the bootstrap operation becomes larger than that at the room temperature.

As a result, the term of $(1-G_b)\times V_{anode}$ in Expression (1) increases, the gate to source voltage $V_{gs}'$ after completion of the bootstrap operation decreases, which results in that the driving current decreases.

The foregoing is the reason that the temperature characteristics appear in the driving current after completion of the bootstrap operation.

Figure 5:
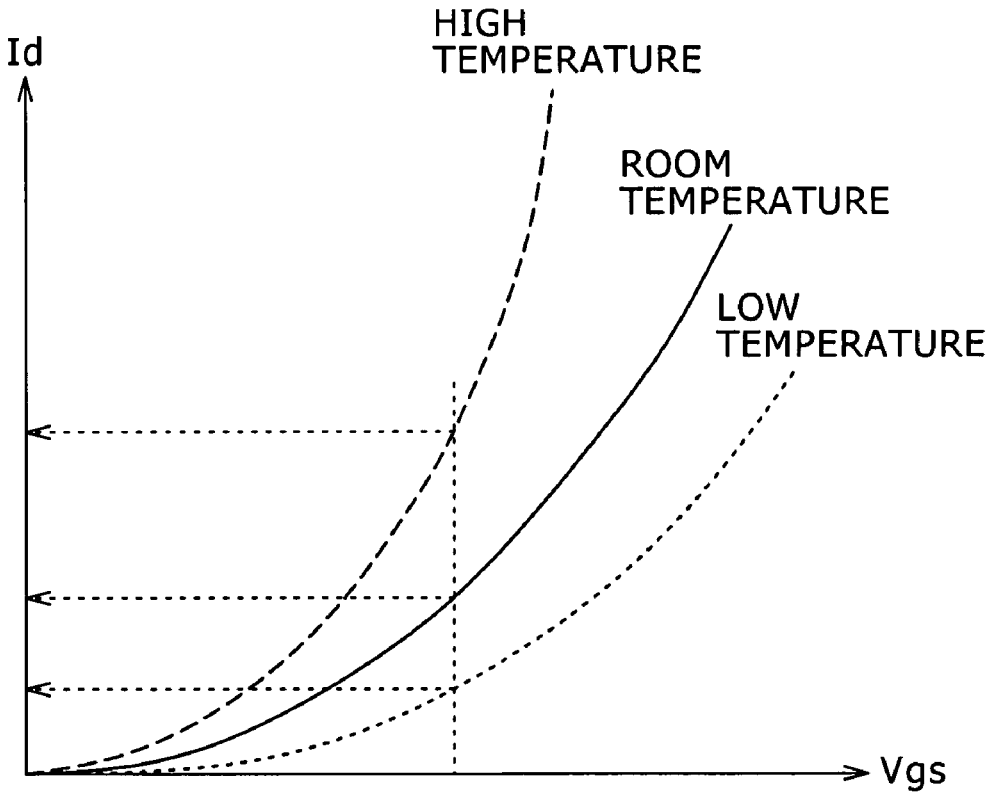
FIG. 5 is a graphical representation explaining temperature characteristics which current vs. voltage characteristics of the drive transistor generally have.

(b) Principles of Fluctuation of Driving Current Due to Temperature Characteristics of Drive Transistor FIG. 5 shows temperature characteristics which the current vs. voltage characteristics of the drive transistor generally have.

As shown in FIG. 5, a mobility of the drive transistor T2 increases with a rise in the driving temperature. Also, when the same gate to source voltage $V_{gs}$ is applied to the drive transistor T2, a current which is caused to flow through the drive transistor T2 further increases at the high temperature than at the low temperature. Contrary, the current decreases at the low temperature.

(c) Conclusion

As has been described so far, in the current control type organic EL display panel, the driving current and the emission luminance fluctuate due to the temperature fluctuation caused by the exothermic heat or the like of the organic EL display panel itself following the environmental temperature and the light emission.

(B) Principles of Correcting Fluctuation of Driving Current

For the purpose of correcting the fluctuation of the driving current due to the temperature characteristics of the organic EL element, it is necessary to hold the gate to source voltage $V_{gs}'$ after completion of the bootstrap operation at a constant value irrespective of the temperature change.

Figure 6:
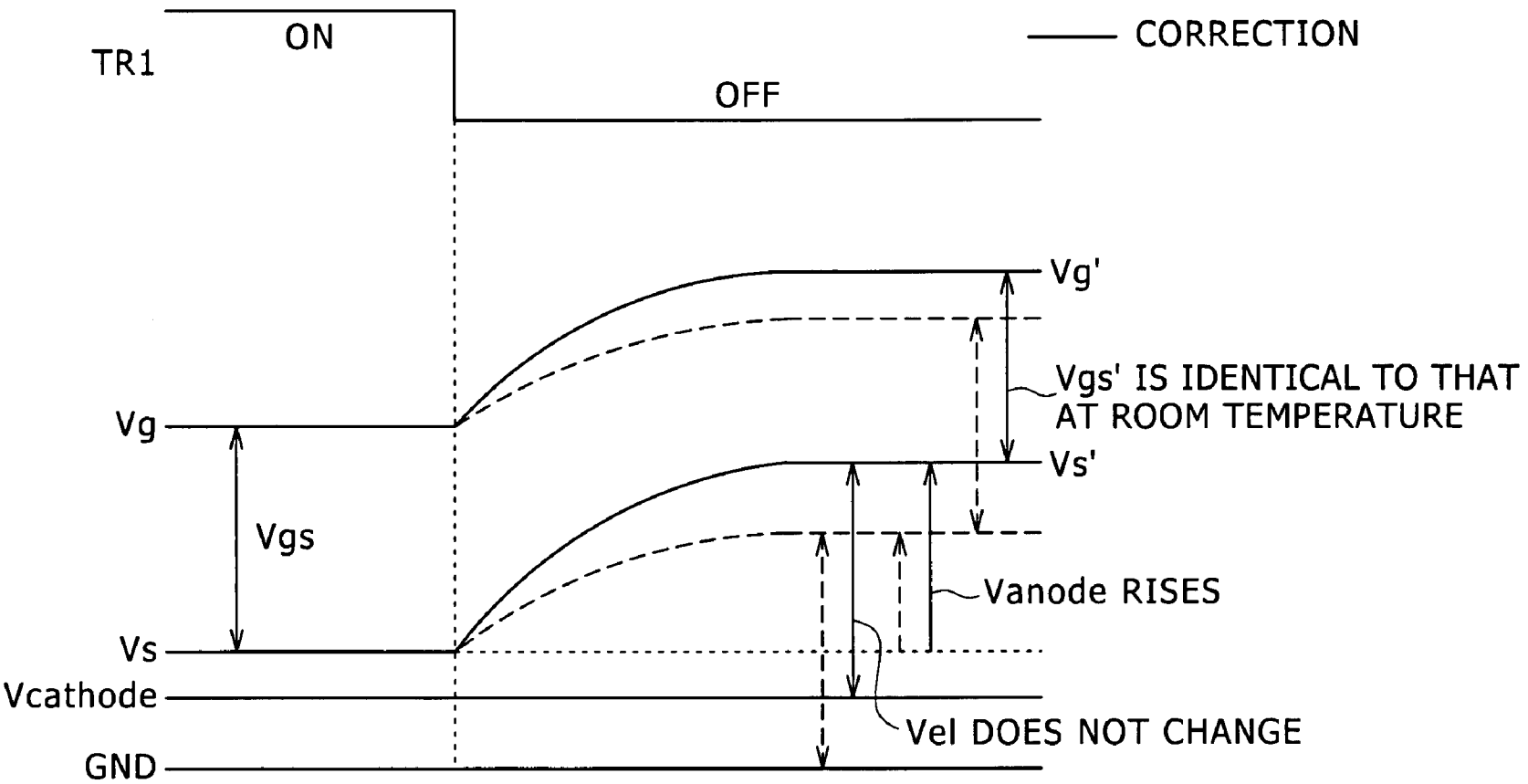
FIG. 6 is a timing chart explaining the correction principles of the present embodiment.

FIG. 6 shows the control principles for correcting the gate to source voltage $V_{gs}'$ at the high temperature to the same value as that at the room temperature.

As shown in FIG. 6, the inventors of the present embodiment makes a device in such a way that a cathode potential $V_{cathode}$ of the organic EL element is caused to rise from the grounding potential GND, which results in that an anode potential $V_{anode}$ of the organic EL element is controlled so as to become the same voltage value as that at the room temperature.

Performing this control operation results in that a value of the anode potential $V_{anode}$ regulating a rise amount of source potential $V_s$ becomes identical to the value of the anode potential $V_{anode}$ at the room temperature. As a result, the gate to source voltage $V_{gs}'$ is controlled so as to become the same state as that at the room temperature. In the manner as described above, the fluctuation of the driving current due to the temperature characteristics of the organic EL element is properly corrected.

By the way, for realization of this correcting operation, it is necessary to perform the following operation. That is to say, a change in electrode to electrode voltage $V_{el}$ of the organic EL element following the fluctuation of the driving temperature is measured. Also, a difference value between that electrode to electrode voltage $V_{el}$ of the organic EL element thus changed and the electrode to electrode voltage $V_{el}$ of the organic EL element at the room temperature is fed back to the cathode potential of the organic EL element.

However, there is a problem in supplying the driving current from the drive transistor T2 for the purpose of measuring the electrode to electrode voltage $V_{el}$ of the organic EL element. The reason for this is because as described above, the drive transistor T2 has the temperature characteristics (refer to FIG. 5), and thus the driving current fluctuates depending on the driving temperatures.

In view of the foregoing, the inventors of the present embodiment proposes the technique with which a constant current source (a current source capable of causing a constant current to flow irrespective of the temperature) which has no temperature characteristics unlike the case of the drive transistor T2 is specially prepared, and a constant current is caused to flow through the organic EL element from the constant current source, thereby measuring the electrode to electrode voltage of the organic EL element.

Specially preparing the constant current source in such a manner makes it possible to separate the temperature characteristics of the driving transistor T2 from the measured value of the electrode to electrode voltage of the organic EL element. As a result, there is ensured the correcting operation in which only the temperature characteristics of the organic EL element are reflected.

(C) Embodiment 1

In Embodiment 1 of the present invention, a detailed description will be given hereinafter with respect to the case where the electrode to electrode voltage (the voltage developed across the anode electrode and the cathode electrode) $V_{el}$ of the organic EL element is measured by using one of the pixels (a pixel for display and measurement) disposed within an effective display region constituting an organic EL panel, and thus the cathode potential supplied to the organic EL panel is controlled.

(C-1) Examples of Disposition of Pixel for Display and Measurement

Figure 7A:
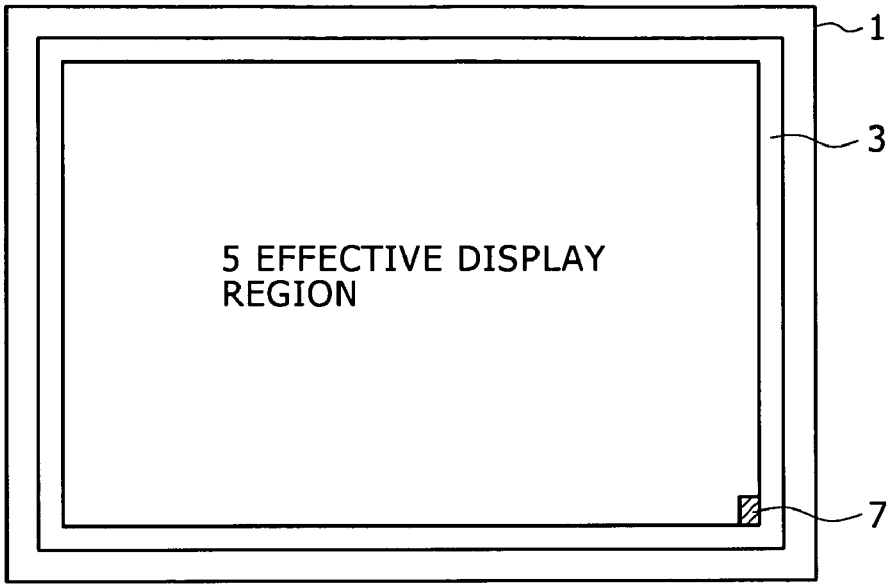
FIGS. 7A and 7B are respectively views showing examples of disposition of a pixel for display and measurement.
Figure 7B:
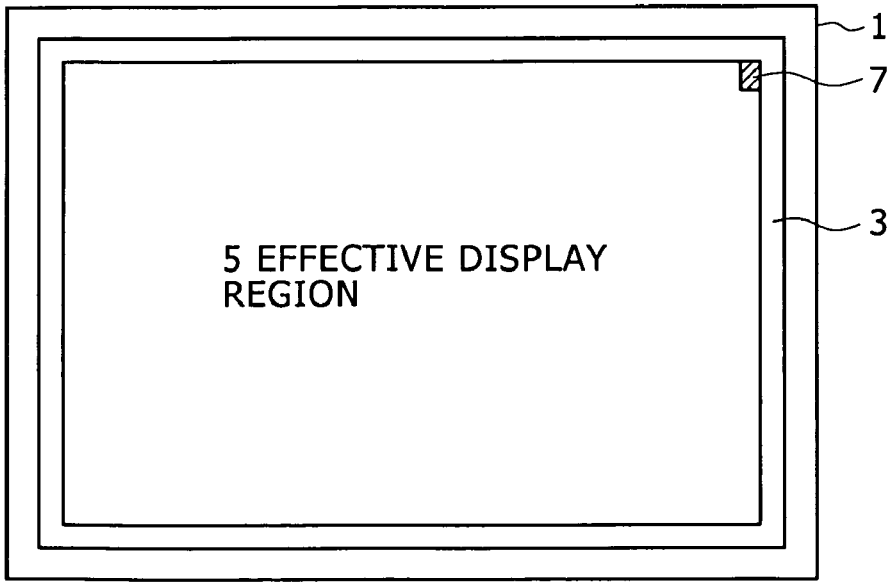

FIGS. 7A and 7B show examples of disposition of the pixel (the pixel for display and measurement) which is used not only for normal picture display, but also for measurement. Each of the pixels 7 for display and measurement shown in FIGS. 7A and 7B, respectively, is disposed on an organic EL panel 3 constituting an organic EL panel module 1. It is noted that in this case, each of the pixels 7 for display and measurement shown in FIGS. 7A and 7B, respectively, is disposed within an effective display region 5 constituting the organic EL panel 3.

FIG. 7A shows an example in which the pixel 7 for display and measurement is disposed in a lower right-hand corner of the effective display region 5 constituting the organic EL panel 3. Also, FIG. 7B shows an example in which the pixel 7 for display and measurement is disposed in an upper right-hand corner of the effective display region 5 constituting the organic EL panel 3.

It is noted that the number of pixels 7 for display and measurement, and the positional disposition of the pixels 7 for display and measurement are arbitrarily set, respectively. However, the pixels 7 for display and measurement are preferably dispersively disposed within the effective display region 5 from a viewpoint of an influence exerted on the displayed image quality, and panel design. More preferably, the pixels 7 for display and measurement are dispersively disposed in a peripheral portion of a screen. Dispersively disposing a plurality of pixels 7 for display and measurement within the effective display region 5 results in that even when there is a temperature dispersion within the screen, an influence thereof can be removed by averaging the measured values.

A pixel configuration of the pixel 7 for display and measurement is assumed to be the same as that of any other pixel within the effective display region 5 except that an extension wiring for measurement of the anode potential of the organic EL element is additionally formed. Therefore, the pixel 7 for display and measurement is formed in exactly the same processes as those for any other pixel within the effective display region 5.

(C-2) Entire Configuration

Figure 8:
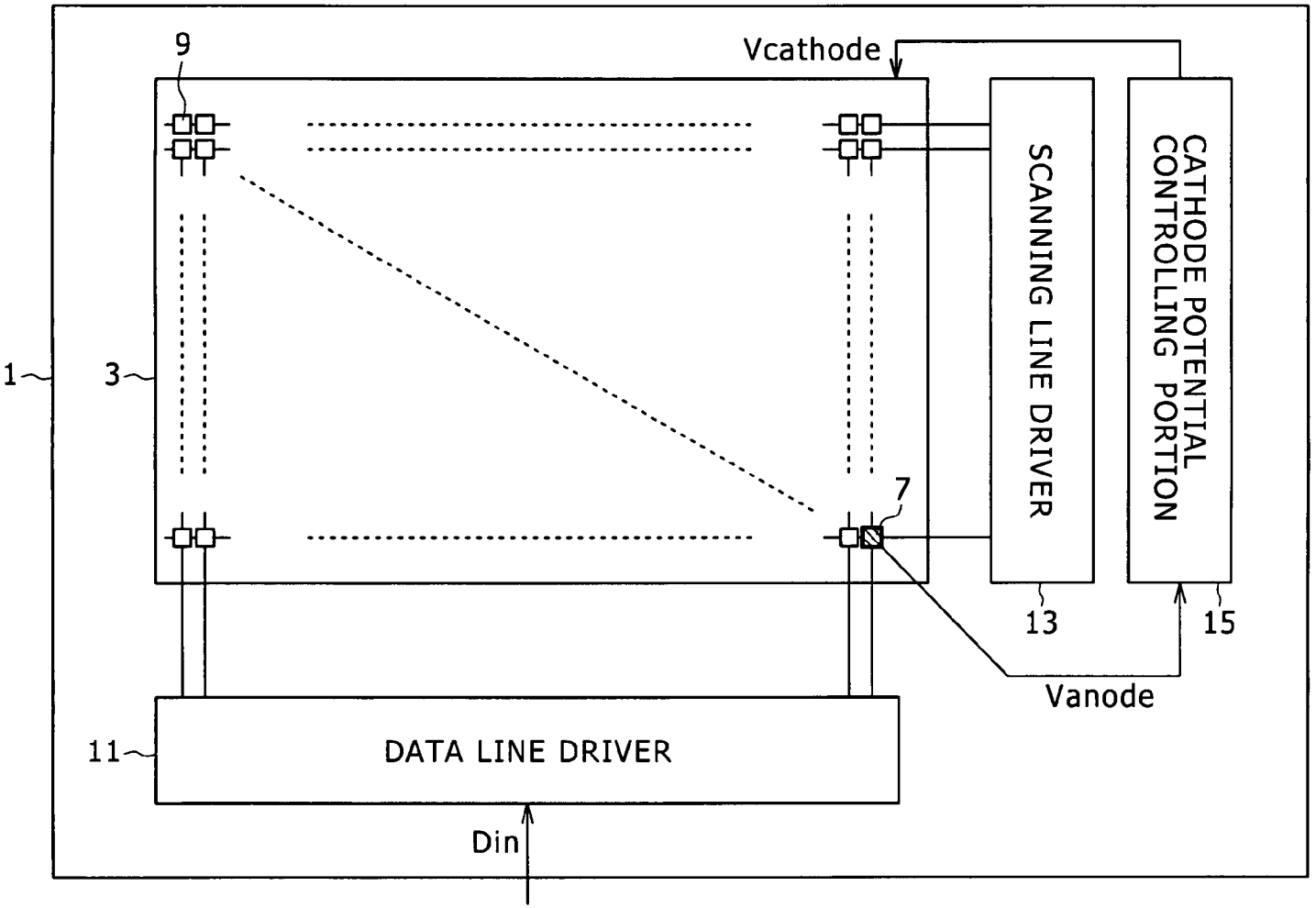
FIG. 8 is a block diagram showing an example of a circuit configuration of an organic EL panel module.

FIG. 8 shows a main constituent portion of the organic EL panel module 1. The organic EL panel module 1 shown in FIG. 8 includes an organic EL panel 3, a data line driver 11, a scanning line driver 13, and a cathode potential controlling portion 15 as main constituent elements.

In the case of Embodiment 1, the organic EL panel 3 is one for color display, and thus the pixels 9 are disposed in a matrix in accordance with the arrangement of emission colors and in correspondence to the panel resolution. However, when the organic EL element having a structure obtained by laminating organic emitting layers for emitting respective lights having a plurality of colors one upon another constitutes the pixels 9, one pixel corresponds to a plurality of emission colors.

It is noted that one of the pixels 9 corresponds to the pixel 7 for display and measurement with which the anode potential of the organic EL element is measured. In the case of Embodiment 1, it is assumed that only one pixel 7 for display and measurement is disposed in the lower right-hand corner of the effective display region 5.

The data line driver 11 is a circuit device for successively applying pixel data (having respective signal voltages $V_{data}$) to data lines DL, respectively. The pixel data stated herein is one in image positions corresponding to the pixels 9 and the pixel 7 for display and measurement which constitute the effective display region 5.

The scanning line driver 13 is a circuit driver for giving writing timings for the signal voltages $V_{data}$. Of course, the scanning line driver 13 drives and controls a scanning line WL as well to which the pixel 7 for display and measurement is connected. It is noted that the scanning lines WL becoming destinations to which the writing timings are given, respectively, are controlled so as to be successively switched in units of horizontal scanning time periods.

The cathode potential controlling portion 15 is a processing device for switching-controlling the supply of a current used for the measurement to the pixel 7 for display and measurement provided for measurement of the anode potential, and controlling the cathode potential common to all the pixels in accordance with the anode potential generated in the phase of supplying the current used for the measurement.

Figure 9:
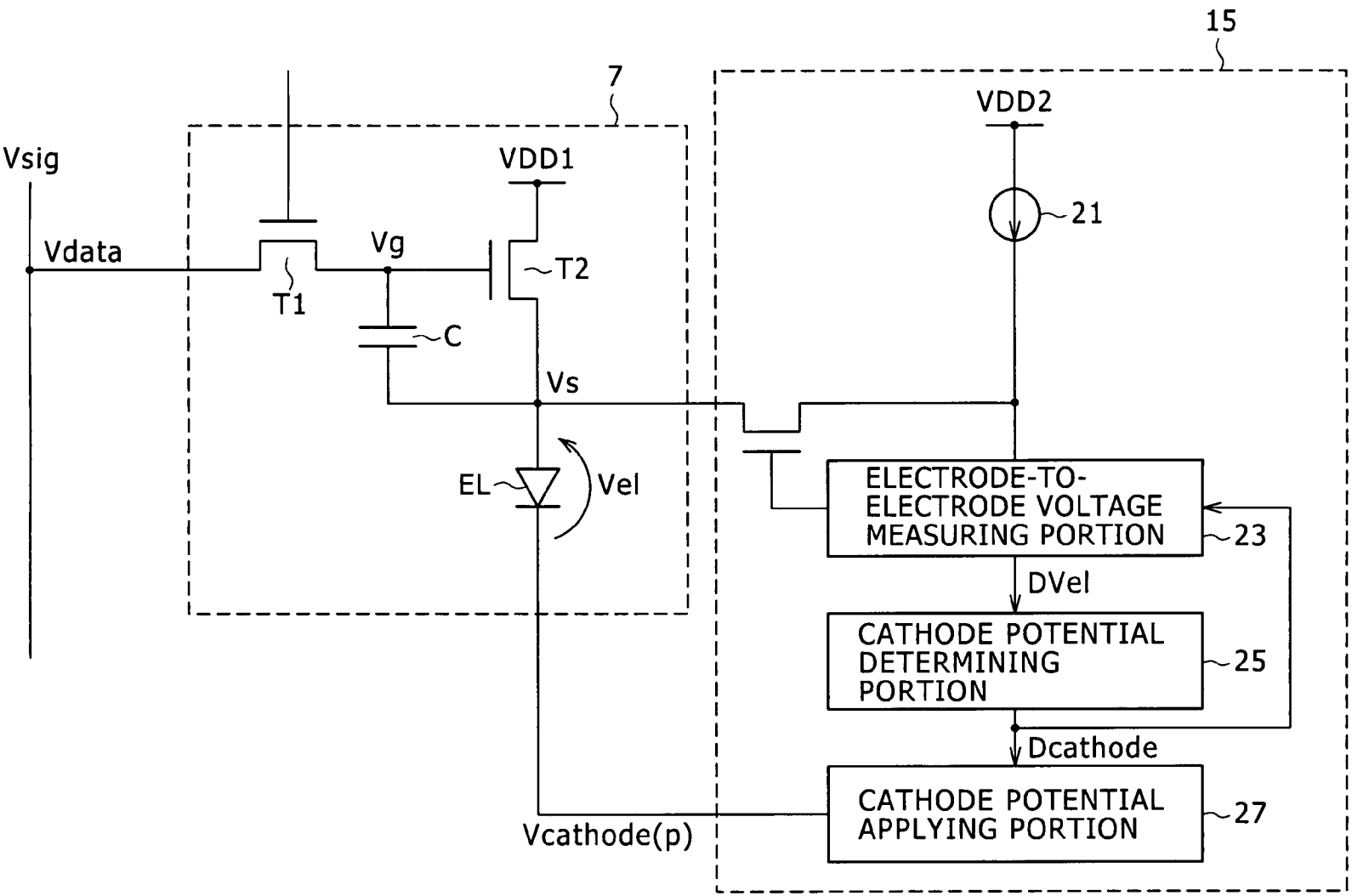
FIG. 9 is a block diagram, partly in circuit, showing an example of an internal configuration of a cathode potential controlling portion.

FIG. 9 shows an internal configuration of the cathode potential controlling portion 15. It is noted that a pixel structure of the pixel 7 for display and measurement is identical to that of each of the general pixels constituting the effective display region 5. In this connection, in the phase of the mounting the cathode potential controlling portion 15, the transistors which are used for correction of a threshold value and mobility correction for the drive transistor T2, respectively, and other elements are connected to the cathode potential controlling portion 15 in some cases.

The cathode potential controlling portion 15 is composed of a changing-over switch (constituted by an N-channel thin film transistor T3), a constant current source 21, an electrode-to-electrode voltage measuring portion 23, a cathode potential determining portion 25, and a cathode potential applying portion 27.

In the case of Embodiment 1, the changing-over switch is constituted by the N-channel thin film transistor T3. That is to say, the N-channel thin film transistor T3 operates as a switch. Also, in the case of Embodiment 1, the switching timing for the N-channel thin film transistor T3 is switched and controlled in accordance with a control signal supplied from the electrode-to-electrode voltage measuring portion 23. Of course, the switching timing can also be given from the outside by using an exclusive line.

Here, when an input image is displayed on the pixel 7 for display and measurement, the N-channel thin film transistor T3 is controlled so as to be turned OFF. On the other hand, when the anode potential of the organic EL element constituting the pixel 7 for display and measurement is measured, the N-channel thin film transistor T3 is controlled so as to be turned ON.

The constant current source 21 is one which can usually supply a constant current because it has no temperature characteristics. Thus, the known current source can be used as the constant current source 21.

The electrode-to-electrode voltage measuring portion 23 is a circuit device for measuring the anode potential of an organic EL element D constituting the pixel 7 for display and measurement.

Figure 10:
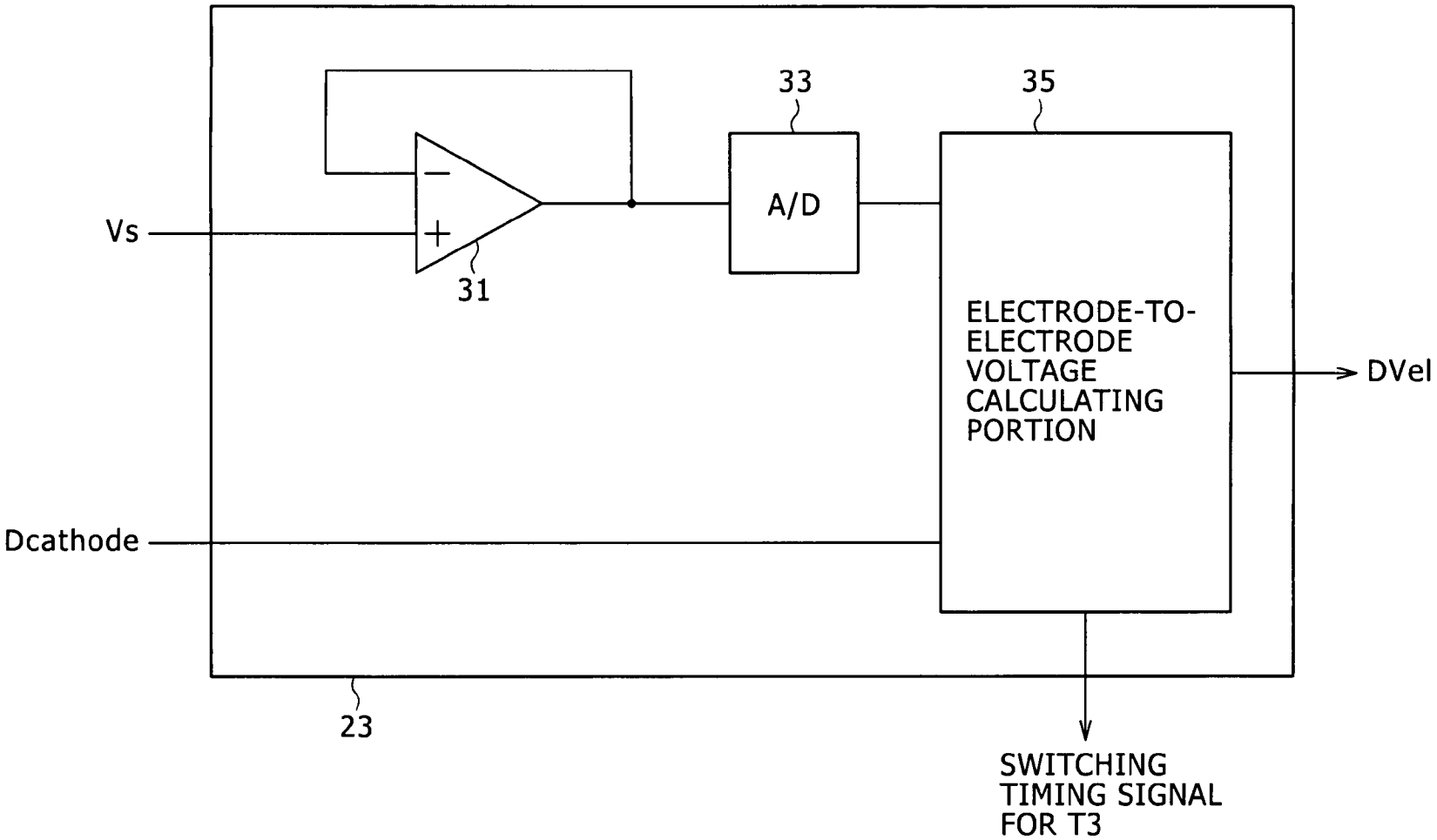
FIG. 10 is a block diagram, partly in circuit, showing an example of an internal configuration of an electrode-to-electrode voltage measuring portion.

FIG. 10 shows an example of an internal configuration of the electrode-to-electrode voltage measuring portion 23. The electrode-to-electrode voltage measuring portion 23 is composed of a voltage follower circuit 31 for measuring an anode potential $V_s$, an analog-to-digital conversion circuit (A/D conversion circuit) 33 and an electrode-to-electrode voltage calculating portion 35.

Here, the reason for use of the voltage follower circuit 31 is because the magnitude of the driving current supplied to the organic EL element D is very minute, that is, on the nanometer order. It is noted that the anode potential $V_s$ measured through the voltage follower circuit 31 has an analog value.

The analog-to-digital conversion circuit 33 is a circuit device for converting the analog potential $V_s$ measured as the analog potential into a digital value.

The electrode-to-electrode voltage calculating portion 35 is a processing device for calculating a potential difference between the anode potential $V_s$ developed at the anode electrode of the organic EL element D, and the cathode potential value $D_{cathode}$ developed at the cathode electrode of the organic EL element D. The arithmetic operation processing as described above is executed by executing digital processing.

A measured value $DV_{el}$ of the electrode to electrode voltage $V_{el}$ of the organic EL element D is calculated by executing the arithmetic operation processing as described above. The reason for the execution of the arithmetic operation processing is because the cathode potential $V_{cathode(p)}$ applied to the cathode electrode of the organic EL element D is variably controlled similarly to the case of other pixels 9 constituting the effective display region 5.

In the case of Embodiment 1, the electrode-to-electrode voltage calculating portion 35 outputs the switching timing signal for the N-channel thin film transistor T3 described above. The reason for this is because the measured value $DV_{el}$ corresponding to the electrode-to-electrode voltage $V_{el}$ is calculated. The electrode-to-electrode voltage calculating portion 35 supplies the measured value $DV_{el}$ thus calculated to the cathode potential determining portion 25.

The cathode potential determining portion 25 calculates a difference value between the measured value $DV_{el}$ calculated in the electrode-to-electrode voltage measuring portion 23, and the electrode-to-electrode voltage $V_{el}$ at the room temperature. Also, the cathode potential determining portion 25 sets the difference voltage thus calculated as a correction value. After that, the cathode potential determining portion 25 adds or subtracts the correction value to or from a reference voltage value, thereby determining the cathode potential value $V_{cathode}$ as a control target value.

Figure 11:
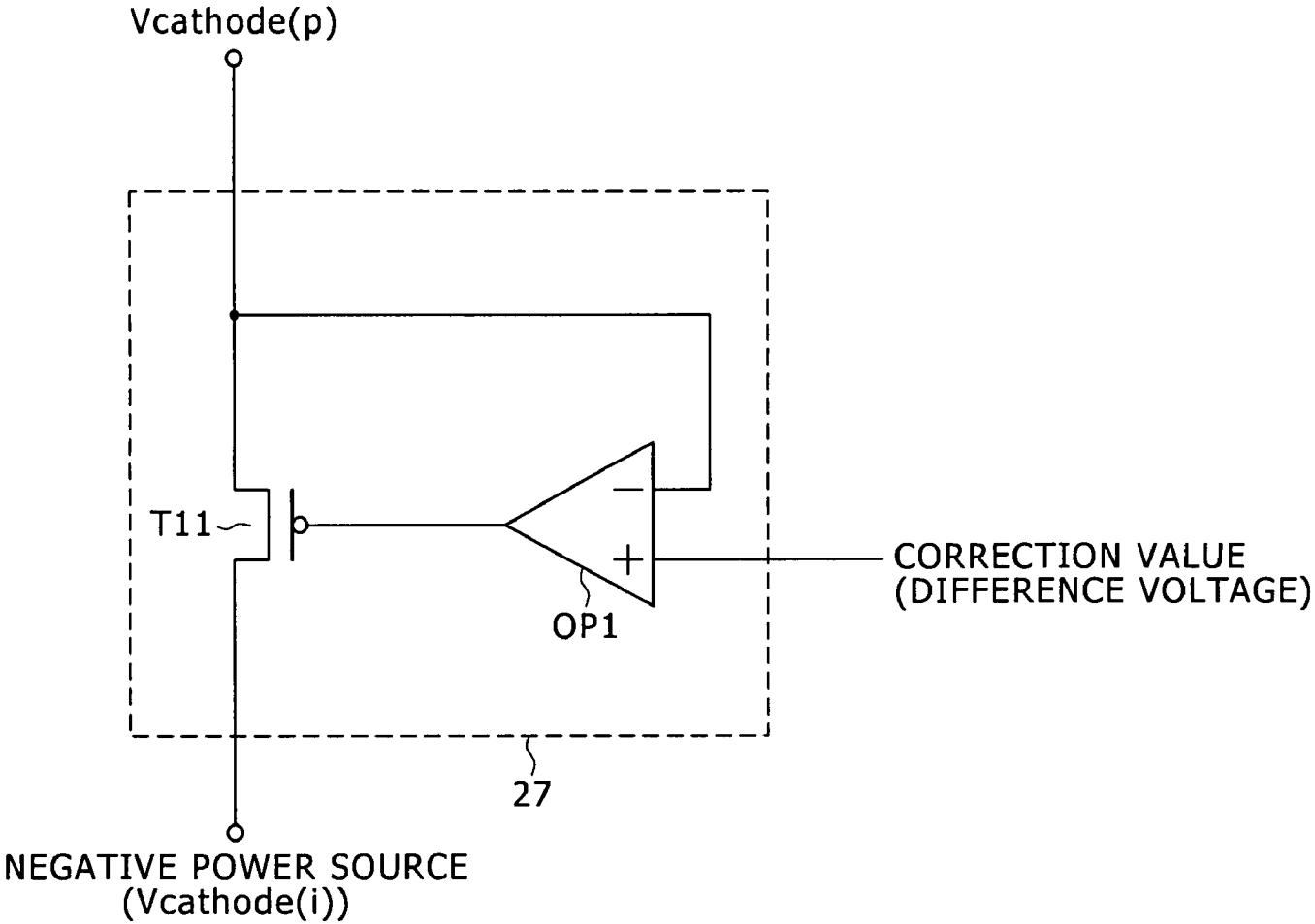
FIG. 11 is a circuit diagram explaining a method of setting a cathode potential value corresponding to an example of setting a reference potential.

The reference voltage value stated herein differs depending on how to give a power source potential on the cathode side as a fixed potential. For example, as shown in FIG. 11, when a reference potential $V_{cathode(i)}$ in the cathode potential applying portion 27 is supplied from a negative power source, zero is used as the reference voltage value. Of course, the reference potential $V_{cathode(i)}$ is set sufficiently lower than a change width of the correction value.

In this case, the cathode potential determining portion 25 directly outputs the correction value (difference value) as a cathode potential value $D_{cathode}$.

As a result, the cathode potential value $D_{cathode}$ at the low temperature becomes equal to or smaller than 0 V. The cathode potential value $D_{cathode}$ at the room temperature becomes 0 V. Also, the cathode potential value $D_{cathode}$ at the high temperature becomes equal to or larger than 0 V.

Figure 12:
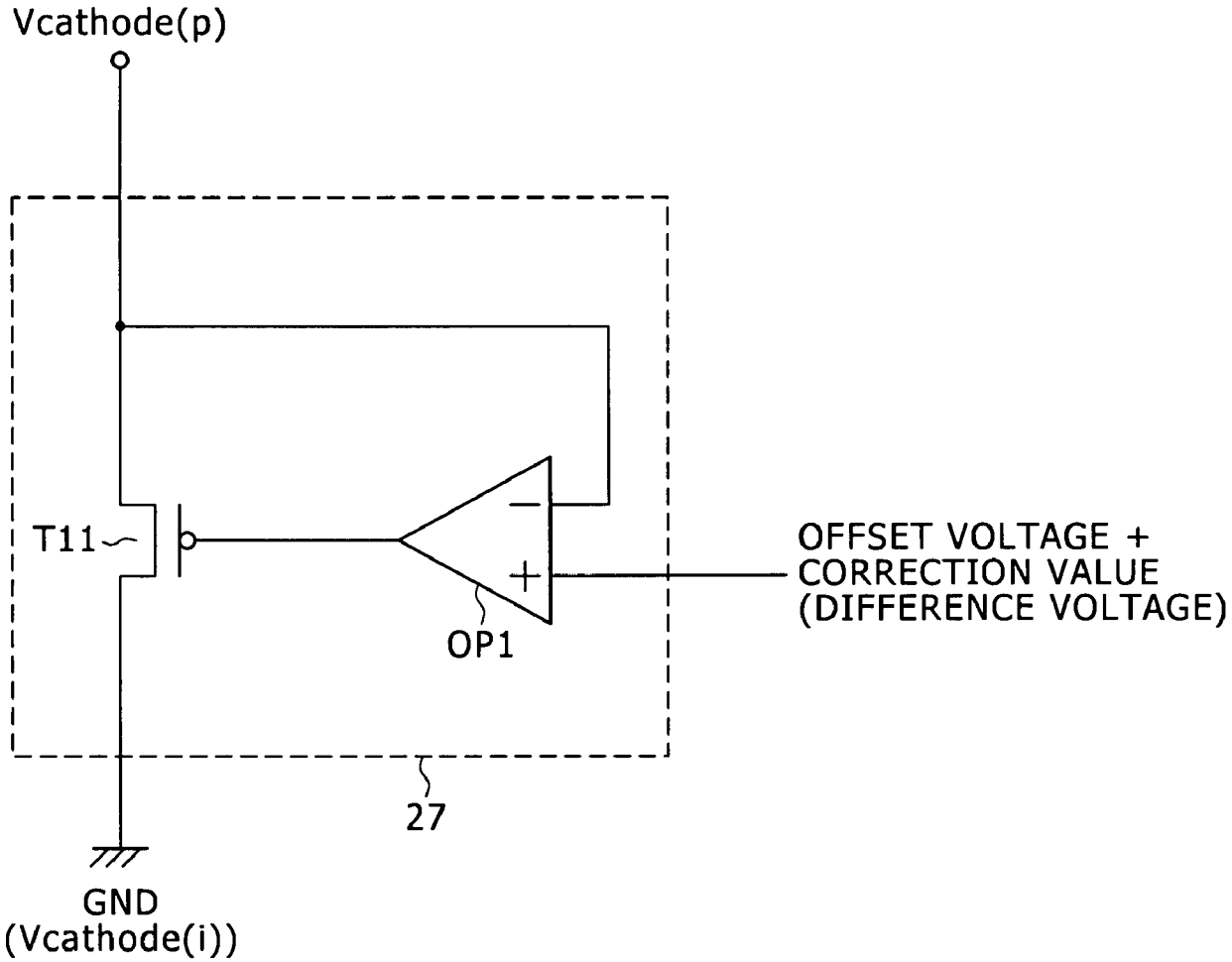
FIG. 12 is a circuit diagram explaining a method of setting an cathode potential value corresponding to another example of setting the reference potential.

In addition, for example, when as shown in FIG. 12, the reference potential $V_{cathode(i)}$ in the cathode potential applying portion 27 is the grounding potential, an offset potential (>0) is used as the reference voltage value.

In this case, the cathode potential $D_{cathode}$ at the low temperature becomes equal to or lower than the offset potential. The cathode potential $D_{cathode}$ at the room temperature becomes the offset value. Also, the cathode potential $D_{cathode}$ at the high temperature becomes equal to or higher than the offset potential.

The cathode potential applying portion 27 is a circuit device for generating a common cathode potential $V_{cathode(p)}$ corresponding to the determined cathode potential value $D_{cathode}$, and applying the common cathode potential $V_{cathode(p)}$ thus generated to a common cathode electrode of the organic EL panel 3.

Figure 13:
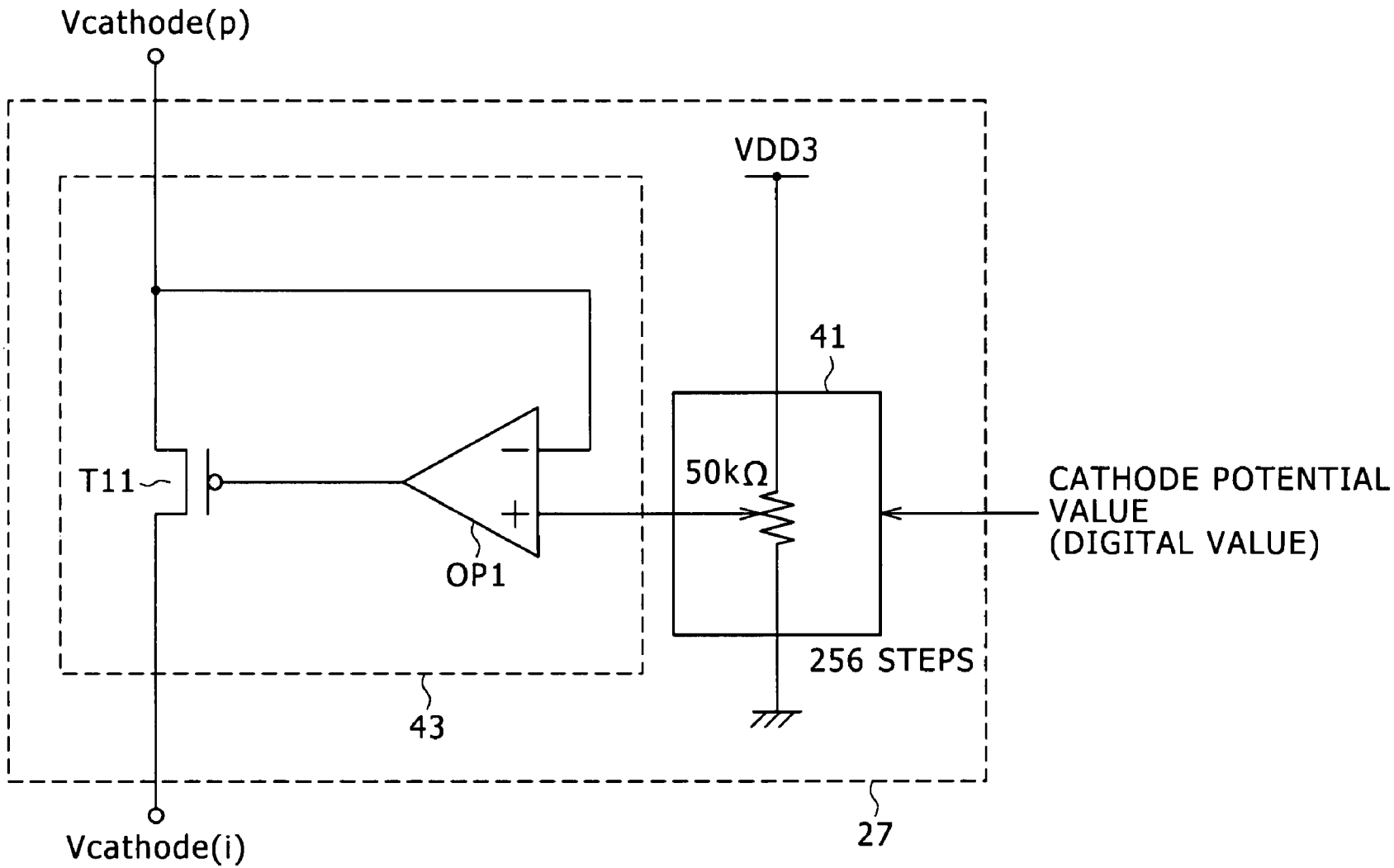
FIG. 13 is a circuit diagram showing an example of an internal configuration of a cathode potential applying portion.

FIG. 13 shows an example of an internal configuration of the cathode potential applying portion 27. The cathode potential applying portion 27 shown in FIG. 13 is composed of a digital potentiometer 41, and a voltage follower circuit (composed of an operational amplifier OP1 and a P-channel field effect transistor T11) 43.

The digital potentiometer 41 is a semi-fixed resistor for generating a voltage in the form of steps (for example, 256 steps (8 bits)) corresponding to a bit length of the cathode potential value $D_{cathode}$ which is inputted thereto in the form of a digital value.

The voltage follower circuit 43 is a circuit device for applying the cathode potential $V_{cathode(p)}$ identical to the input voltage value to the common cathode electrode in accordance with the feedback control. As a result, the common cathode electrode in the organic EL panel 3 can be controlled so as to follow the temperature change in the organic EL element D.

(C-3) Effects

As has been described so far, according to Embodiment 1 of the present invention, it is possible to realize the separation of the organic EL element D from the temperature characteristics of the drive transistor T2, and it is possible to readily correct the fluctuation of the driving current owing to the temperature characteristics which the current vs. voltage characteristics of the organic EL element generally have.

Figure 14:
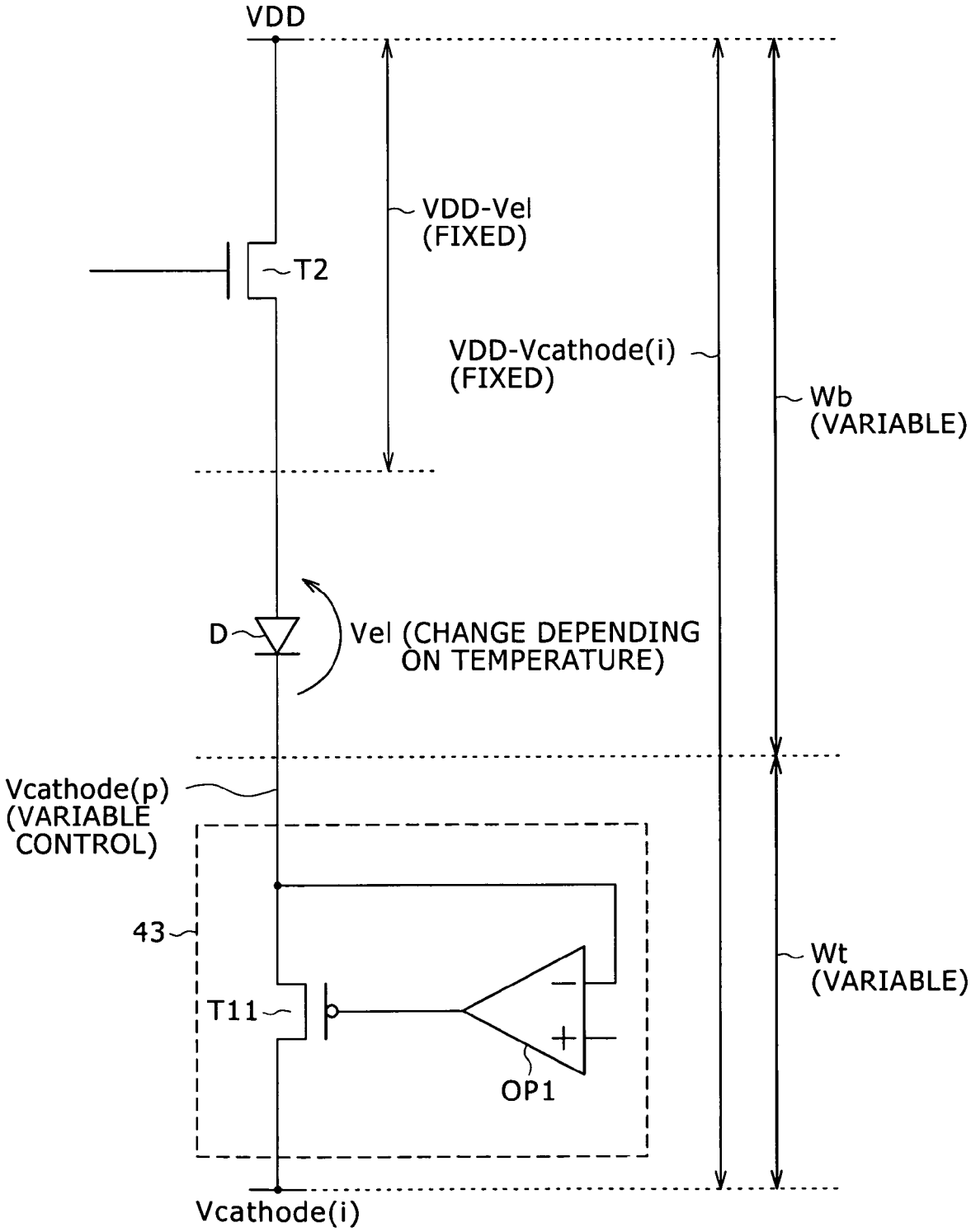
FIG. 14 is a circuit diagram showing a relationship between a power consumed in the cathode potential applying portion and a power consumed in an organic EL panel.

In addition, in the case of Embodiment 1 of the present invention, the potential applied to the cathode electrode of the organic EL element D rises with the rise in the temperature. For this reason, the voltage applied to the potential circuit portion can fall by an amount of potential risen. FIG. 14 shows this voltage relationship.

It is understood from FIG. 14 that the voltage between the power source voltage VDD and a reference potential $V_{cathode}(t)$ is fixed, and also the voltage applied to the voltage follower circuit 43 increases or decreases by a amount of voltage changed applied to the pixel circuit portion.

Therefore, even when this control method is adopted, the power consumption of the entire organic EL panel module can be held unchanged.

If anything, it is also possible to expect an effect of suppressing a rise in the panel temperature because the power consumed in the pixel circuit portion is reduced (that is, an exothermic quantity of pixel circuit portion is reduced) in the phase of the rise in the temperature.

In addition, according to Embodiment 1 of the present invention, for a time period other than the time period for measurement, of the electrode to electrode voltage of the organic EL element, performed along with the temperature fluctuation, the N-channel thin film transistor T3 is controlled so as to be turned OFF, so that the pixel 7 for display and measurement can be used in the normal display operation. Therefore, the circuit configuration can be simplified as compared with the case where the dummy pixel dedicated to the measurement is prepared. As a result, it is possible to avoid the cost-up of the self light emission display device.

In addition, according to Embodiment 1 of the present invention, it is possible to directly add the dispersion as well in the temperature distribution within the surface of the organic EL panel 3 because the pixels disposed within the effective display region 5 can be used.

(D) Embodiment 2

In Embodiment 2 of the present invention, a detailed description will now be given with respect to the case where the electrode to electrode voltage $V_{el}$ of the organic EL element is directly measured by using dummy pixels each having the same configuration as that of each of the pixels disposed within an effective display region, and the cathode potential in the organic EL panel is controlled. However, the actual processing operation in Embodiment 2 is the same as that in Embodiment 1 except that measurement elements are merely exclusively disposed.

(D-1) Examples of Disposition of Pixels for Display and Measurement

Figure 15A:
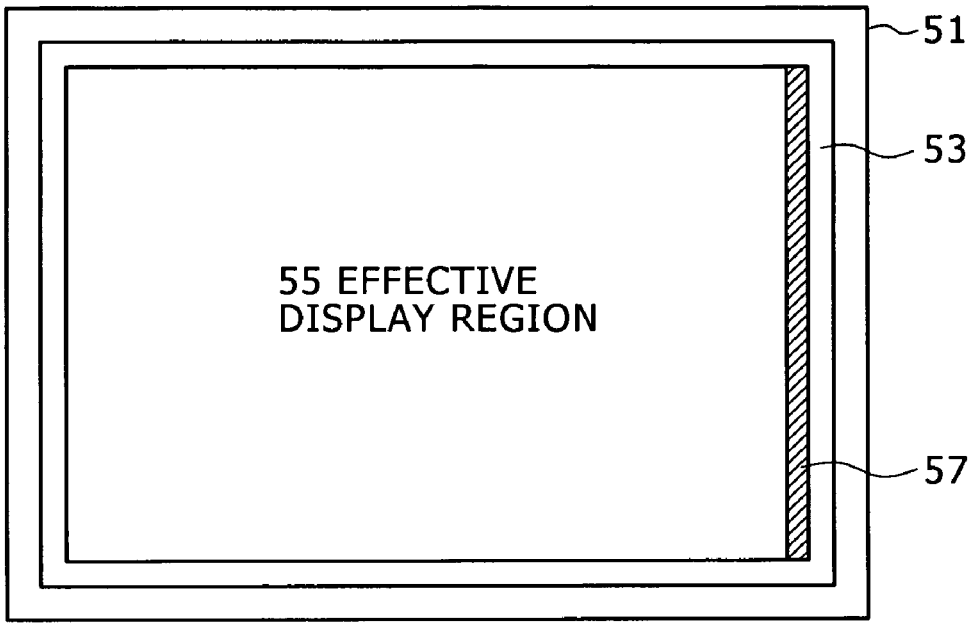
FIGS. 15A and 15B are respectively views showing examples of disposition of dummy pixels.
Figure 15B:
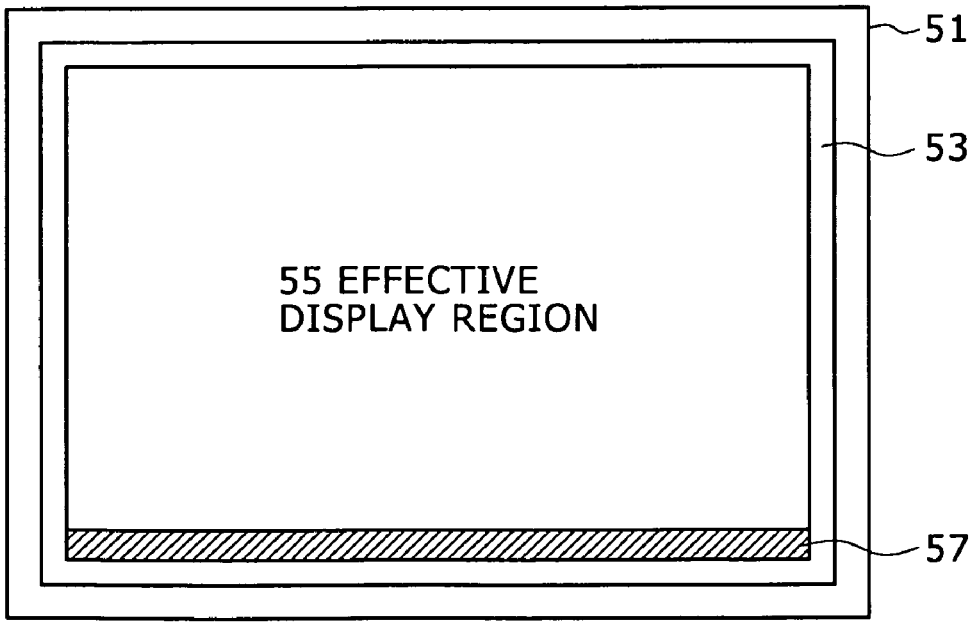

FIGS. 15A and 15B show respectively examples of disposition of pixels (pixels for display and measurement) which are used not only for the normal picture display, but also for the measurement. The dummy pixels 57 shown in each of FIGS. 15A and 15B are also displayed on an organic EL panel 53 constituting an organic EL panel module 51.

However, each of the dummy pixels 57 is disposed outside the effective display region 55. That is to say, each of the dummy pixels 57 is disposed in a region (a region which can not be normally seen from a user) which is unrelated to the picture display.

FIG. 15A shows an example in which the dummy pixels 57 are disposed on an outer right-hand side of the effective display region 55 constituting the organic EL panel 53. Also, FIG. 15B shows an example in which the dummy pixels 57 are disposed on a lower outer side of the effective display region 55 constituting the organic EL panel 53.

It is noted that a pixel configuration of each of the dummy pixels 57 is the same as that of each of the pixels constituting the effective display region 55. Therefore, each of the dummy pixels 57 is formed in the same processes as those for each of the pixels constituting the effective display region 55.

(D-2) Entire Configuration

Figure 16:
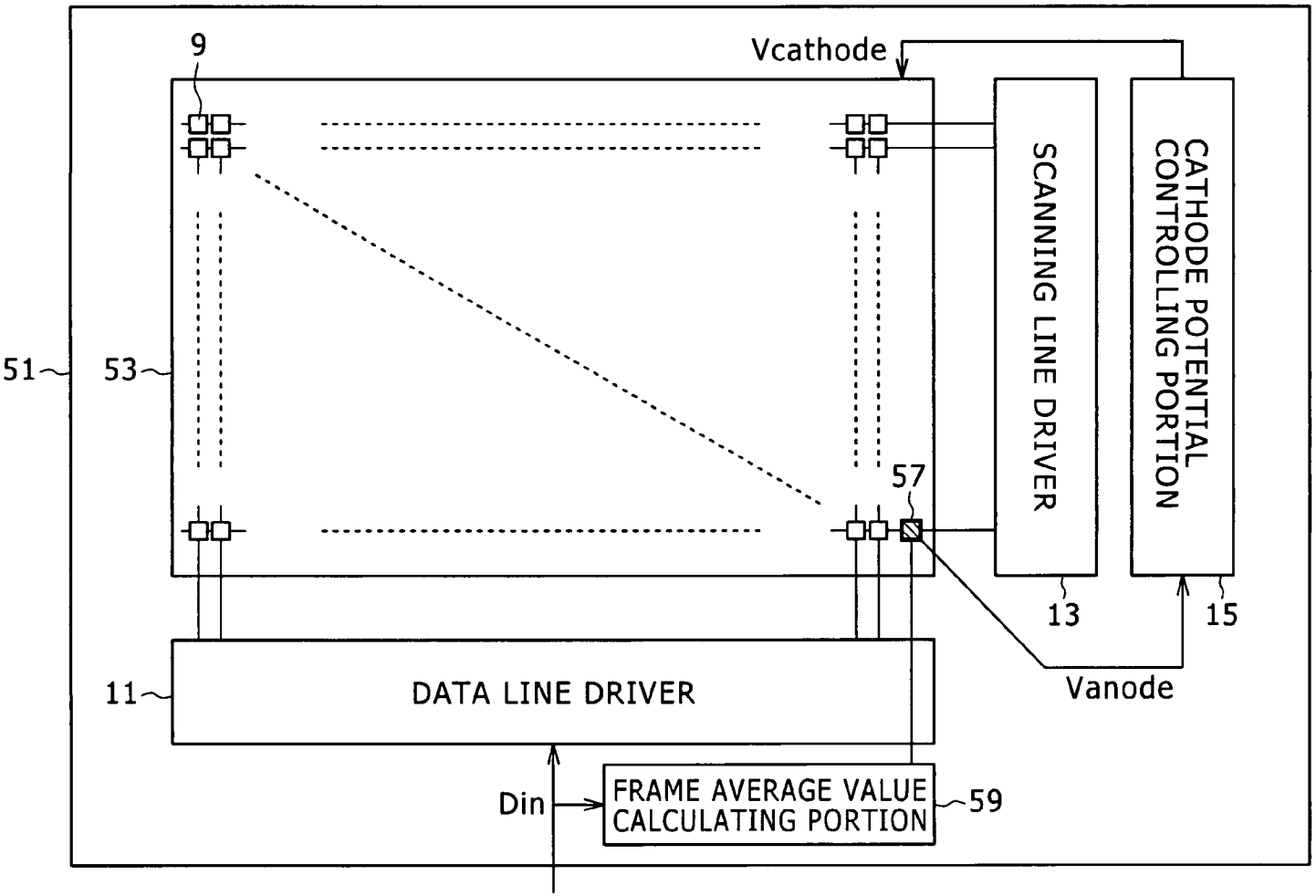
FIG. 16 is a block diagram showing a circuit configuration of an organic EL panel module.

FIG. 16 shows a main constituent portion of the organic EL panel module 51. The organic EL panel module 51 includes the organic EL panel 53, the data line driver 11, the scanning line driver 13, the cathode potential controlling portion 15, and a frame average value calculating portion 59 as the main constituent elements.

FIG. 16 also shows the case where only one dummy pixel 57 is disposed on a lower right-hand corner of the organic EL panel 53. Now, it is known that the electrode to electrode voltage $V_{el}$ fluctuates depending on the degree as well of the progress of the deterioration of the pixel. For this reason, it is preferably from a viewpoint of the measurement precision that the deterioration state of each of the dummy pixels 57 reflects on the deterioration state of the entire organic EL panel. In view of this respect, in Embodiment 2, the frame average value calculating portion 59 for calculating a frame average value about input image data $D_{in}$ is disposed in the organic EL panel module 51. Thus, the frame average value calculating portion 59 supplies the frame average value calculated therein to the dummy pixel 57 for a time period other than the time period necessary for giving the measurement timing.

Of course, when the dummy pixel 57 can be regarded as reflecting the deterioration state and the driving temperature of the entire organic EL panel 53, the frame average value calculating portion 59 is not necessarily disposed in the organic EL panel module 51. In this case, the light emission of the dummy pixel 57 must be controlled with specific gradation values for the time period other than the time period necessary for giving the measurement timing.

For example, the driving current may be supplied from the constant current source 21 to the dummy pixel 57. Of course, in this state, it is preferably that the driving current is not continuously supplied from the constant current source 21 to the dummy pixel 57, but the control is carried out so that a given ratio is obtained between the time period for the supply and the supply-stop time period.

(D-3) Effects

In Embodiment 2 as well of the present invention, the same effects as those in Embodiment 1 can be offered except for use of the dummy pixel 57.

(E) Other Embodiments (E-1) Another Circuit Configuration of the Cathode Potential Controlling Portion In each of Embodiments 1 and 2, the description has been given so far with respect to the case where the changing-over switch (constituted by the N-channel thin film transistor T3) is disposed on the wiring path connecting the constant current source 21 and the anode electrode of the organic EL element.

However, in the case where it is thought that a resistance component is generated due to the disposition of the changing-over switching, and it exerts an influence on the measurement precision of the anode voltage $V_{anode}$ to be measured, it is recommended to adopt the configuration of using no changing-over switching.

(E-2) Correction for Temperature Characteristics which Emission Property has

In each of Embodiments 1 and 2, the description has been given with respect to the case where the cathode potential of the organic EL element is controlled so as to remove the fluctuation of the driving current due to only the temperature characteristics of the organic EL element.

However, even when the fluctuation of the driving current due to the temperature characteristics of the organic EL element is corrected, there is the possibility that the emission luminance fluctuates due to the emission property of the organic EL element for the driving current.

In this case, the correction value (difference value) calculated in the cathode potential determining portion 25 must be corrected in accordance with the temperature characteristics of the emission property.

(E-3) Adjustment for White Balance

In each of Embodiments 1 and 2, the description has been given with respect to the case where the cathode potential of the organic EL element common to all the pixels is variably controlled in accordance with the measurement results irrespective of the difference among the emission colors.

However, when the cathode electrodes of the organic EL elements are partitively disposed on the organic EL panel so as to correspond to R, G and B, respectively, the electrode to electrode voltages $V_{el}$ of the organic EL elements must be measured individually so as to correspond to R, G and B, and each of the cathode potentials of the organic EL elements must be controlled so that the gate to source voltage $V_{gs}$ after completion of the bootstrap operation becomes constant.

In this case, even when the temperature characteristics which the current vs. voltage characteristics of the organic EL element generally have differ among the colors, the white balance can be held by correcting the fluctuation of the driving current.

However, with the method of individually controlling the cathode electrodes of the organic EL elements partitively disposed so as to correspond to R, G and B, respectively, it may be impossible to avoid that the circuit configuration is complicated.

Therefore, when the simplification of the circuit configuration is prioritized, it is preferably that similarly to the case of each of Embodiments 1 and 2 described above, the cathode electrode of the organic EL element common to all the colors is prepared, and the cathode potential of the organic EL element is controlled by using either the average value of the electrode to electrode voltages $V_{el}$ individually measured so as to correspond to R, G and B, respectively, or any one of these electrode to electrode voltages $V_{el}$ thus measured.

(E-4) Examples of Products (a) Drive Integrated Circuit

In the explanation stated above, the description has been given so far with respect to the organic EL panel module in which the pixel array portion (organic EL panel) and the drive circuits (such as the data line driver, the scanning line driver, and the cathode potential controlling portion) are formed on one base.

However, the pixel array portion, the drive circuit portion and the like can be individually manufactured, and can be distributed in the form of the independent products, respectively. For example, the drive circuits can be manufactured in the form of the independent drive integrated circuits (ICs), and can be distributed independently of the pixel array portion.

(b) Display Module

Figure 17:
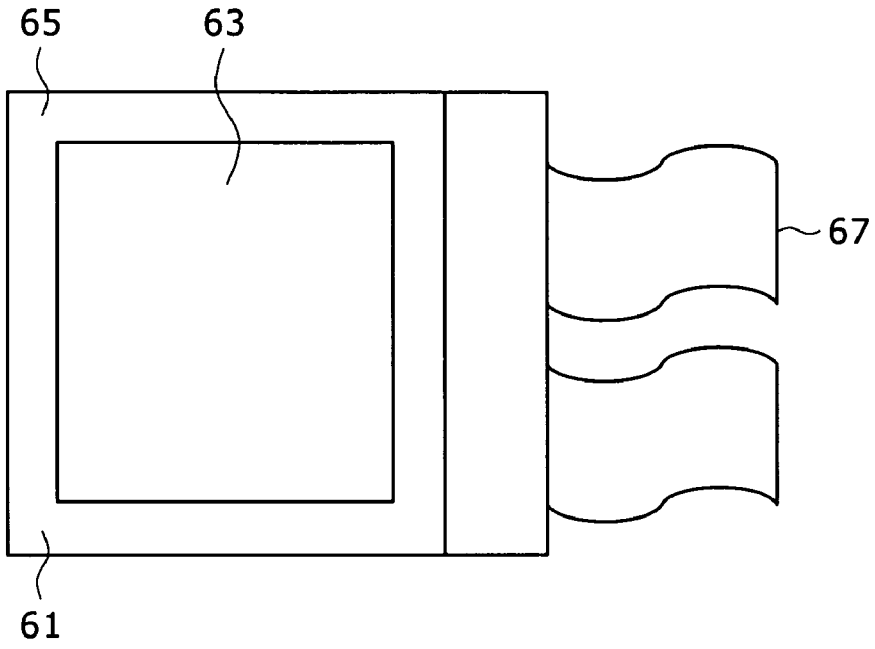
FIG. 17 is a view showing an example of a structure of a display module.

The organic EL panel module according to each of Embodiments 1 and 2 described above can also be distributed in the form of a panel organic EL module having an appearance structure shown in FIG. 17.

An organic EL module 61 has a structure in which a counter portion 63 is stuck to a surface of a supporting substrate 65.

The counter portion 63 includes a glass or any other suitable transparent member as a base material. Also, a color filter, a protective film, a light shielding film, and the like are disposed on a surface of the counter portion 63.

It is noted that a flexible printed circuit (FPC) 67 for inputting/outputting a signal or the like the supporting substrate 65 from the outside, or the like may be provided in the organic EL panel module 61.

(c) Electronic Apparatuses

The organic EL module according to each of Embodiments 1 and 2 described above can also be distributed in the form of a commercial product mounted to an electronic apparatus.

Figure 18:
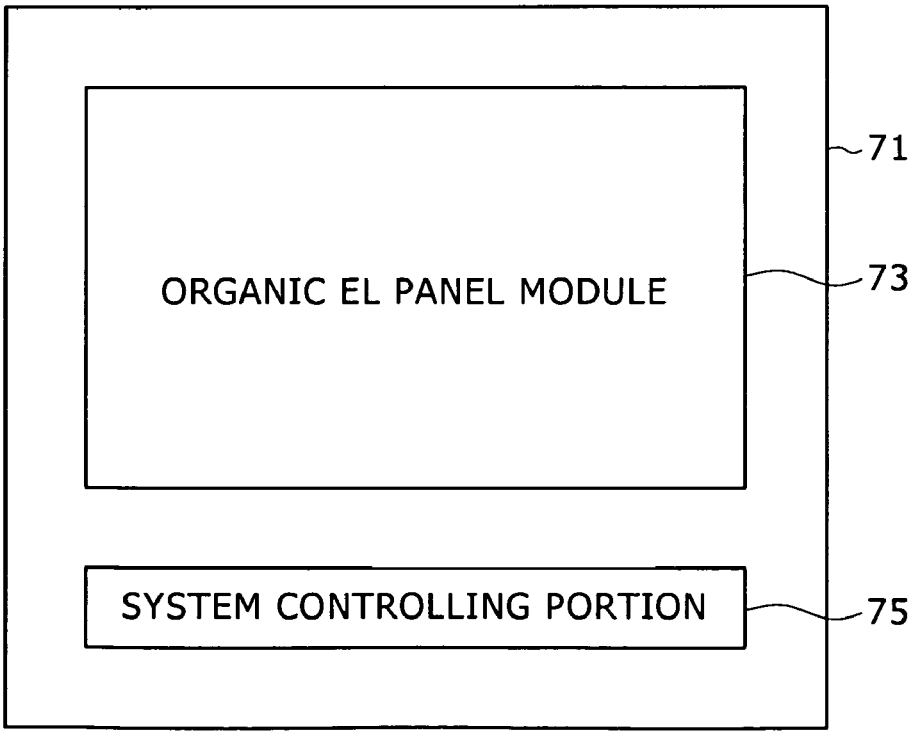
FIG. 18 is a block diagram showing an example of a functional structure of an electronic apparatus.

FIG. 18 shows an example of a conceptual configuration of the electronic apparatus 71. The electronic apparatus 71 is composed of the organic EL panel module 73 described above, and a system controlling portion 75. The contents of the processing executed in the system controlling portion 75 differ depending on the commercial product form of the electronic apparatus 71.

It is noted that the electronic apparatus 71 is by no means limited to an apparatus in a specific field as long as it is equipped with a function of displaying an image or a video picture the data on which is generated in the apparatus or is inputted from the outside.

Figure 19:
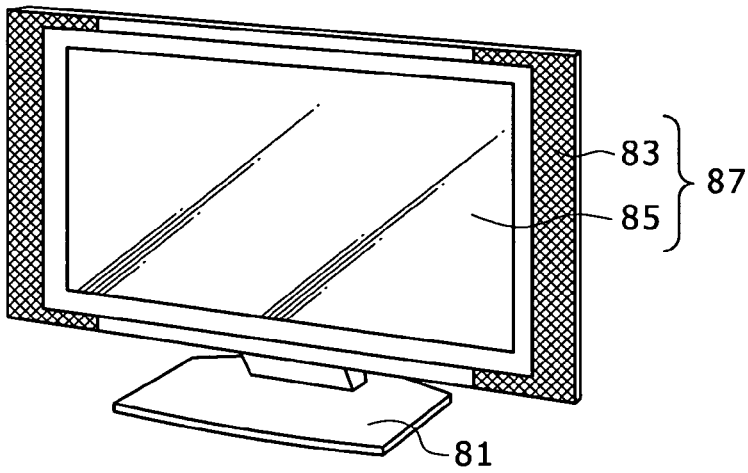
FIG. 19 is a view showing a commercial product example of an electronic apparatus.

For example, a television receiver is supposed as this sort of electronic apparatus 71. FIG. 19 shows an appearance example of a television receiver 81.

A display screen 87 composed of a front panel 83, a filter glass 85, and the like is disposed on the front of a chassis of the television receiver 81. In this case, the display screen 87 corresponds to the organic EL panel module 1 described in each of Embodiments 1 and 2.

Figure 20A:
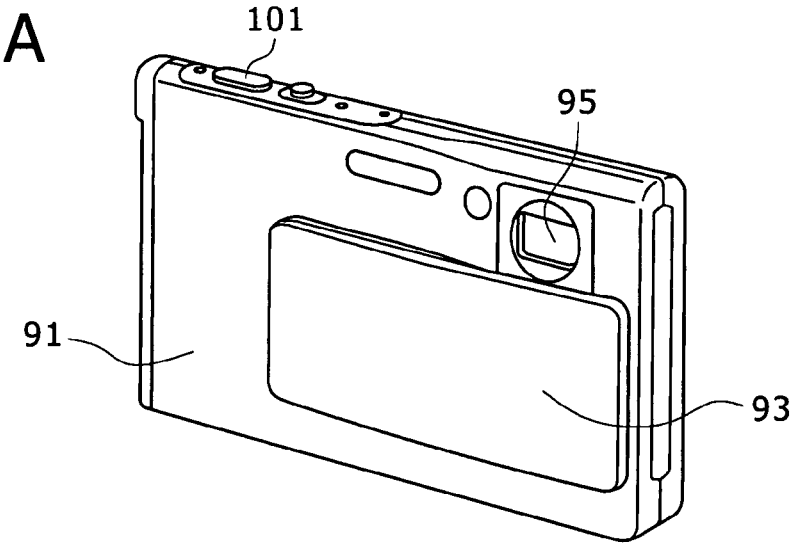
FIGS. 20A and 20B are respectively views each showing another commercial product example of an electronic apparatus.
Figure 20B:
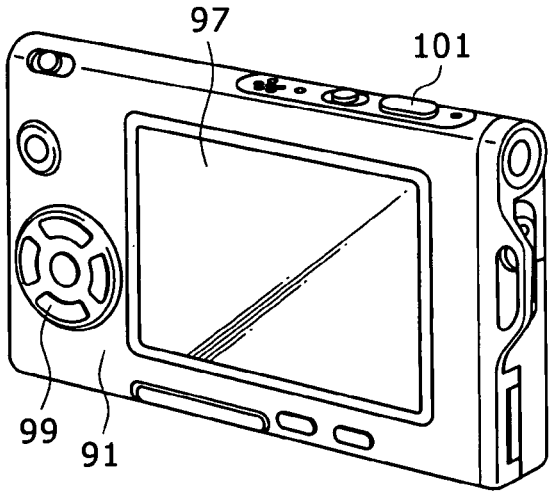

In addition, for example, a digital camera is supposed as this sort of electronic apparatus 71. FIGS. 20A and 20B show appearance examples of a digital camera 91, respectively. FIG. 20A shows the appearance example on the front side (on a subject side) of the digital camera 91, and FIG. 20B shows the appearance example on a back surface side (on a photographer side).

The digital camera 91 is composed of a protective cover 93, a photographing lens portion 95, a display screen 97, a control switch 99, and a shutter button 101. Of these constituent elements, the display screen 97 corresponds to the organic EL panel module 1 described in each of Embodiments 1 and 2.

Figure 21:
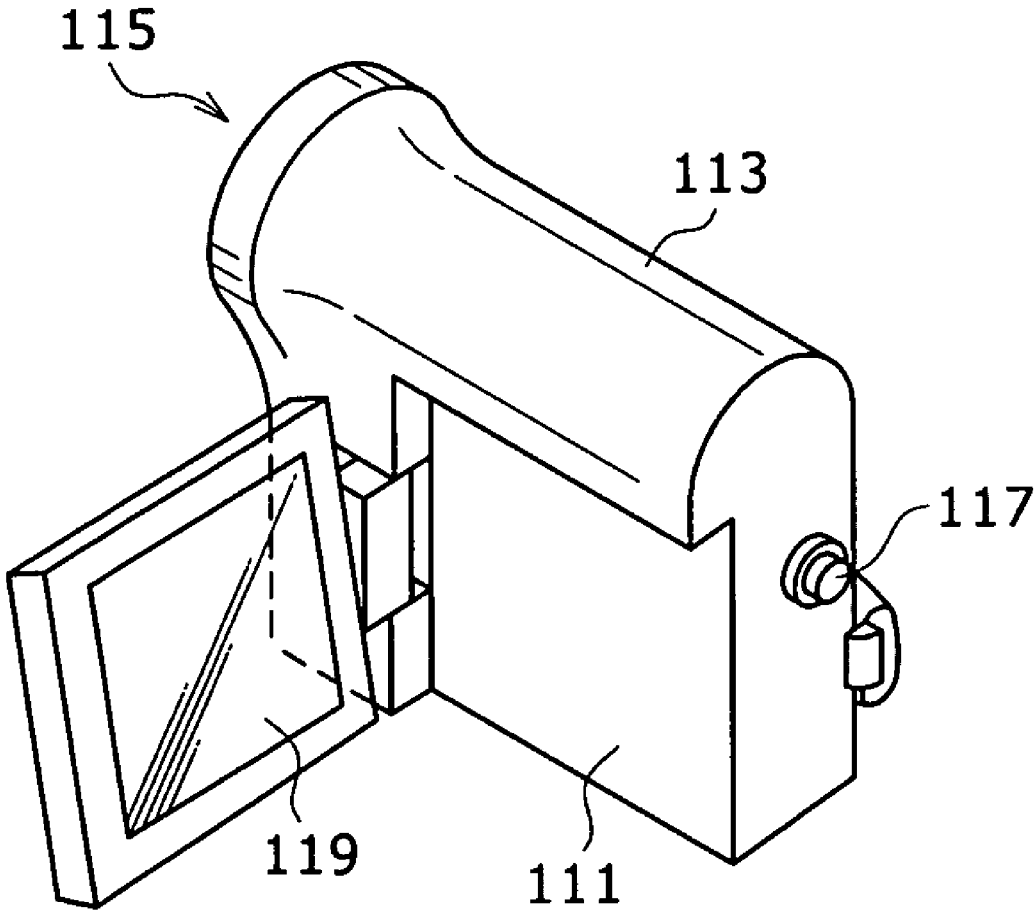
FIG. 21 is a view showing still another commercial product example of an electronic apparatus.

In addition, for example, a video camera is supposed as this sort of electronic apparatus 71. FIG. 21 shows an appearance example of a video camera 111.

The video camera 111 is composed of a photographing lens 115 which is provided on the front side of a main body 113 and which is used to photograph a subject, a start/stop switch 117 with which the photographing is started/stopped, and a display screen 119. Of these constituent elements, the display screen 119 corresponds to the organic EL module 1 described in each of Embodiments 1 and 2.

Figure 22A:
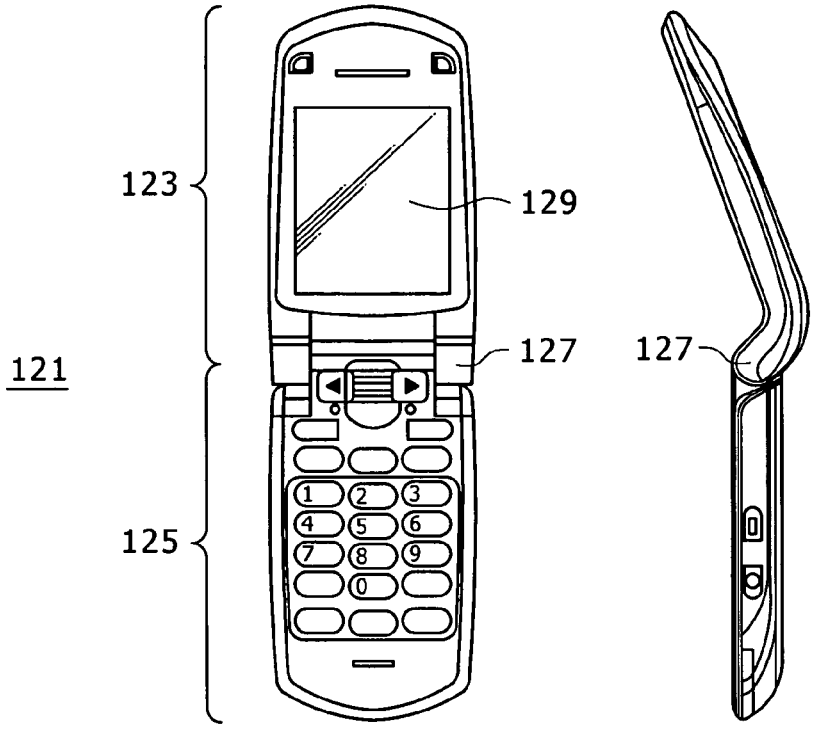
FIGS. 22A and 22B are respectively views each showing yet another commercial product example of an electronic apparatus.
Figure 22B:
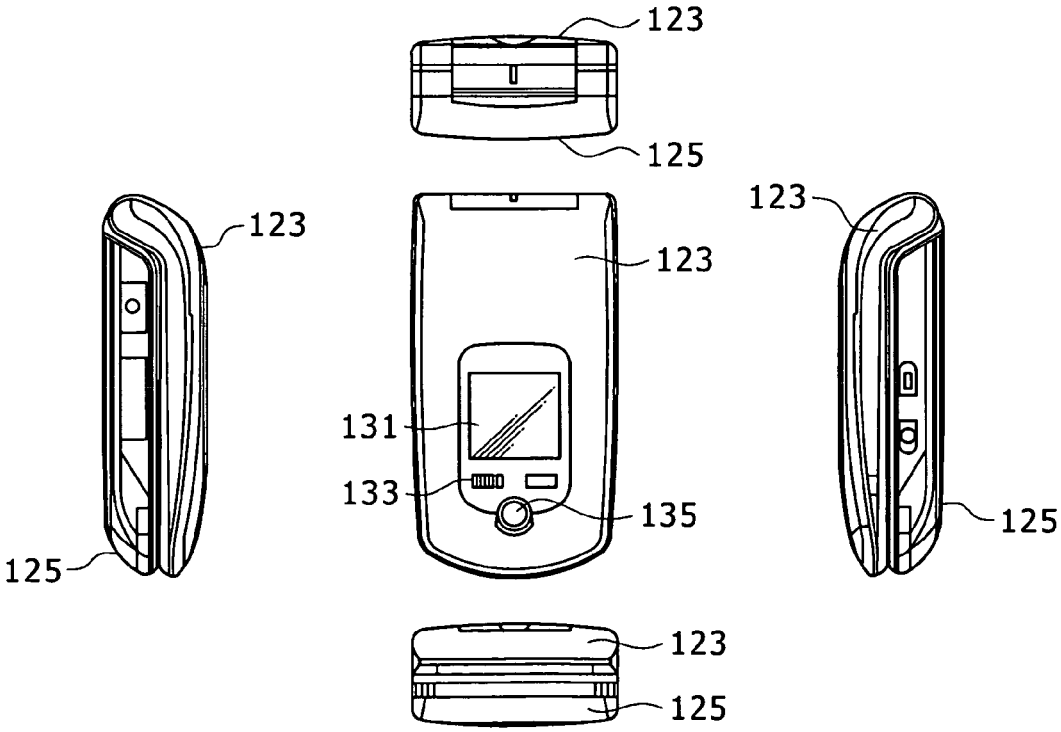

In addition, for example, mobile terminal equipment is supposed as this sort of electronic apparatus 71. FIGS. 22A and 22B show appearance examples of a mobile phone 121 as the mobile terminal equipment, respectively. The mobile phone 121 shown in FIGS. 22A and 22B is of a folding type. FIG. 22A shows the appearance example in a state in which a chassis of the mobile phone 121 is opened, and FIG. 22B shows the appearance example in a state in which the chassis of the mobile phone 121 is folded.

The mobile phone 121 is composed of an upper chassis 123, a lower chassis 125, a joining portion (a hinge portion in this example) 127, a display screen 129, an auxiliary display screen 131, a picture light 133, and a photographing lens 135. Of these constituent elements, each of the display screen 129 and the auxiliary display screen 131 corresponds to the organic EL panel module 1 described in each of Embodiments 1 and 2.

Figure 23:
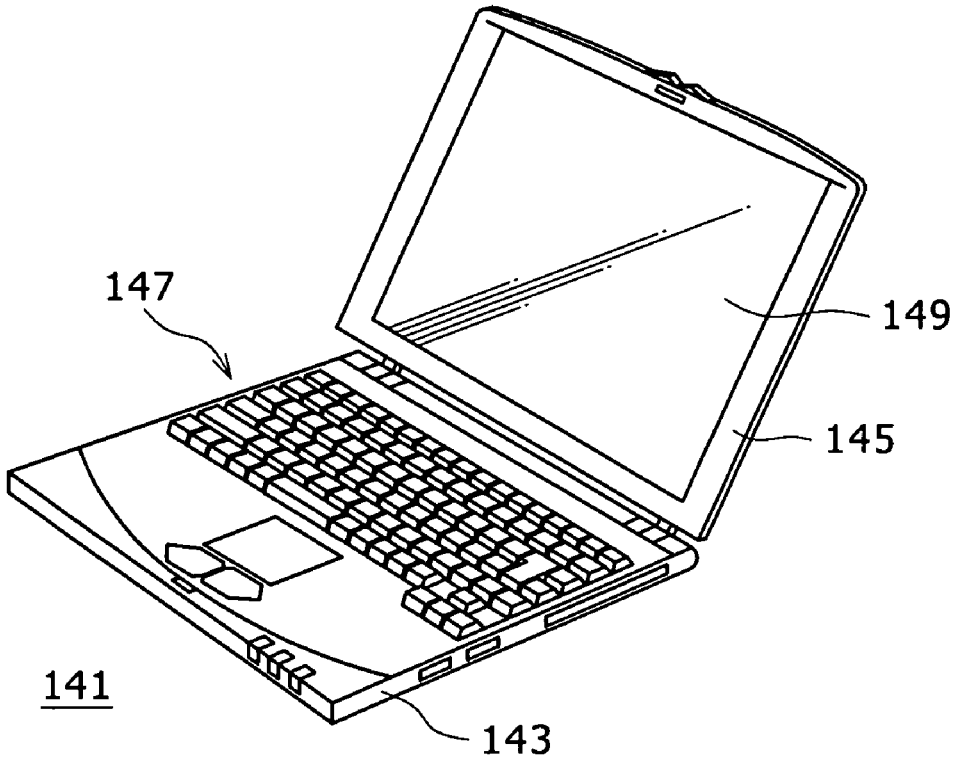
FIG. 23 is a view showing a further commercial product example of an electronic apparatus.

In addition, for example, a computer is supposed as this sort of electronic apparatus 71. FIG. 23 shows an appearance example of a notebook computer 141.

The notebook computer 141 is composed of a lower chassis 143, an upper chassis 145, a keyboard 147 and a display screen 149. Of these constituent elements, the display screen 149 corresponds to the organic EL panel module 1 described in each of Embodiments 1 and 2.

In addition thereto, an audio reproducing apparatus, a game console, an electronic book, an electronic dictionary or the like is supposed as this sort of electronic apparatus 71.

(E-5) Examples of Other Display Devices

In each of Embodiments 1 and 2, the description has been given with respect to the case where the common cathode potential of the organic EL element in the organic EL panel module is controlled.

However, the cathode potential controlling function can also be applied to any other self light emission display device. For example, the cathode potential controlling function can also be applied to an inorganic EL display device, a display device having LEDs arranged therein, or any other display device in which light emitting elements each having a diode structure are arranged on a screen.

(E-6) Control Device Configuration

In the above explanation, the description has been given with respect to the case where the cathode potential controlling function is realized in the form of the hardware.

However, a part of the cathode potential controlling function may also be realized in the form of software processing.

(E-7) Others

Various changes are conceivable for Embodiments 1 and 2 described above without departing from the gist of the invention. In addition, there are conceivable various changes and application examples which are obtained by creation or combination made based on the description in this specification.

What is claimed is:

1. A cathode potential controller for controlling a common cathode potential applied to a self light emission type display panel in which an emission state of each of pixels is driven and controlled in accordance with an active matrix drive system, said cathode potential controller comprising:

a self light emitting element for voltage measurement disposed outside an effective display region;

a constant current source for supplying a constant current to said self light emitting element for voltage measurement;

an electrode-to-electrode voltage measuring portion measuring a potential developed at an anode electrode of said self light emitting element for voltage measurement, and measuring an electrode to electrode voltage of said self light emitting element for voltage measurement;

a cathode potential determining portion determining a cathode potential value by using a difference value between a measured value of the electrode to electrode voltage of said self light emitting element for voltage measurement, and a reference voltage value as a correction value; and a cathode potential applying portion applying a cathode potential corresponding to the determined cathode potential value to a common cathode electrode of said self light emission type display panel.

2. The cathode potential controller according to claim 1, wherein the reference voltage value is the electrode to electrode voltage of said self light emitting element for voltage measurement at a room temperature.

3. The cathode potential controller according to claim 1, wherein when a power source voltage on a cathode electrode side is given in a form of a grounding potential, said cathode potential determining portion determines a value which is obtained by correcting an offset potential value with the difference value as the cathode potential value.

4. The cathode potential controller according to claim 1, wherein when a power source voltage on a cathode electrode side is supplied from a negative power source, said cathode potential determining portion determines the difference value as the cathode potential value.

5. A cathode potential controller for controlling a common cathode potential applied to a self light emission type display panel in which an emission state of each of pixels is driven and controlled in accordance with an active matrix drive system, said cathode potential controller comprising:

a constant current source for voltage measurement disposed outside an effective display region for supplying a constant current to a self light emitting element for display and measurement constituting a specific pixel, said self light emitting element for display and measurement being disposed inside said effective display region;

an electrode-to-electrode voltage measuring portion measuring a potential developed at an anode electrode of said self light emitting element for display and measurement constituting said specific pixel in a phase of measuring an electrode to electrode voltage of said self light emitting element for display and measurement, and measuring the electrode to electrode voltage of said self light emitting element for display and measurement;

a cathode potential determining portion determining a cathode potential value by using a difference value between a measured value of the electrode to electrode voltage of said self light emitting element for display and measurement, and a reference voltage value as a correction value; and a cathode potential applying portion applying a cathode potential corresponding to the determined cathode potential value to a common cathode electrode of said self light emission type display panel.

6. The cathode potential controller according to claim 5, wherein the reference voltage value is the electrode to electrode voltage of said self light emitting element for display and measurement at a room temperature.

7. The cathode potential controller according to claim 5, wherein when a power source voltage on a cathode electrode side is given in a form of a grounding potential, said cathode potential determining portion determines a value which is obtained by correcting an offset potential value with the difference value as the cathode potential value.

8. The cathode potential controller according to claim 5, wherein when a power source voltage on a cathode electrode side is given from a negative power source, said cathode potential determining portion determines the difference value as the cathode potential value.

9. The cathode potential controller according to claim 5, further comprising a switching element disposed an a wiring path between said constant current source for voltage measurement and said specific pixel for switching-controlling supply of a constant current to said self light emitting element for voltage measurement constituting said specific pixel, said switching element being controlled so as to be closed in a phase of measuring the electrode to electrode voltage of said self light emitting element for voltage measurement, and being controlled so as to be opened in a phase of displaying an input image.

10. A self light emission display device comprising:

a self light emission type display panel for driving and controlling an emission state of each of pixels in accordance with an active matrix drive system;

a self light emitting element for voltage measurement disposed outside an effective display region;

a constant current source for supplying a constant current to said self light emitting element for voltage measurement;

an electrode-to-electrode voltage measuring portion measuring a potential developed at an anode electrode of said self light emitting element for voltage measurement, and measuring an electrode to electrode voltage of said self light emitting element for voltage measurement;

a cathode potential determining portion determining a cathode potential value by using a difference value between a measured value of the electrode to electrode voltage of said self light emitting element for voltage measurement, and a reference voltage value as a correction value; and a cathode potential applying portion applying a cathode potential corresponding to the determined cathode potential value to a common cathode electrode of said self light emission type display panel.

11. A self light emission display device comprising:

a self light emission type display panel for driving and controlling an emission state of each of pixels in accordance with an active matrix drive system;

a constant current source for voltage measurement disposed outside an effective display region for supplying a constant current to a self light emitting element for display and measurement constituting a specific pixel, said self light emitting element for display and measurement being disposed inside said effective display region;

an electrode-to-electrode voltage measuring portion measuring a potential developed at an anode electrode of said self light emitting element for display and measurement constituting said specific pixel in a phase of measuring an electrode to electrode voltage of said self light emitting element for display and measurement, and measuring the electrode to electrode voltage of said self light emitting element for display and measurement;

a cathode potential determining portion determining a cathode potential value by using a difference value between a measured value of the electrode to electrode voltage of said self light emitting element for display and measurement, and a reference voltage value as a correction value; and a cathode potential applying portion applying a cathode potential corresponding to the determined cathode potential value to a common cathode electrode of said self light emission type display panel.

12. An electronic apparatus comprising:

a self light emission type display panel for driving and controlling an emission state of each of pixels in accordance with an active matrix drive system;

a self light emitting element for voltage measurement disposed outside an effective display region;

a constant current source for supplying a constant current to said self light emitting element for voltage measurement;

an electrode-to-electrode voltage measuring portion measuring a potential developed at an anode electrode of said self light emitting element for voltage measurement, and measuring an electrode to electrode voltage of said self light emitting element for voltage measurement;

a cathode potential determining portion determining a cathode potential value by using a difference value between a measured value of the electrode to electrode voltage of said self light emitting element for voltage measurement, and a reference voltage value as a correction value;

a cathode potential applying portion applying a cathode potential corresponding to the determined cathode potential value to a common cathode electrode of said self light emission type display panel;

a system controlling portion; and a manipulation inputting portion for said system controlling portion.

13. An electronic apparatus comprising:

a self light emission type display panel for driving and controlling an emission state of each of pixels in accordance with an active matrix drive system;

a constant current source for voltage measurement disposed outside an effective display region for supplying a constant current to a self light emitting element for display and measurement constituting a specific pixel, said self light emitting element for display and measurement being disposed inside said effective display region;

an electrode-to-electrode voltage measuring portion measuring a potential developed at an anode electrode of said self light emitting element for display and measurement constituting said specific pixel in a phase of measuring an electrode to electrode voltage of said self light emitting element for display and measurement, and measuring the electrode to electrode voltage of said self light emitting element for display and measurement;

a cathode potential determining portion determining a cathode potential value by using a difference value between a measured value of the electrode to electrode voltage of said self light emitting element for display and measurement, and a reference voltage value as a correction value;

a cathode potential applying portion applying a cathode potential corresponding to the determined cathode potential value to a common cathode electrode of said self light emission type display panel;

a system controlling portion; and a manipulation inputting portion for said system controlling portion.

14. A cathode potential controlling method of controlling a common cathode potential applied to a self light emission type display panel in which an emission state of each of pixels is driven and controlled in accordance with an active matrix drive system, said self light emission type display panel having a self light emitting element for voltage measurement disposed outside an effective display region, and a constant current source for supplying a constant current to said self light emitting element for voltage measurement, said cathode potential controlling method comprising the steps of:

measuring a potential developed at an anode electrode of said self light emitting element for voltage measurement, and measuring an electrode to electrode voltage of said self light emitting element for voltage measurement;

determining a cathode potential value by using a difference value between a measured value of the electrode to electrode voltage of said self light emitting element for voltage measurement, and a reference voltage value as a correction value; and applying a cathode potential corresponding to the determined cathode potential value to a common cathode electrode of said self light emission type display panel.

15. A cathode potential controlling method of controlling a common cathode potential applied to a self light emission type display panel in which an emission state of each of pixels is driven and controlled in accordance with an active matrix drive system, said self light emission type display panel being a constant current source for voltage measurement disposed outside an effective display region for supplying a constant current to a self light emitting element for display and measurement constituting a specific pixel, said self light emitting element for display and measurement being disposed inside said effective display region, said cathode potential controlling method comprising the steps of:

measuring a potential developed at an anode electrode of said self light emitting element for display and measurement constituting said specific pixel in a phase of measuring an electrode to electrode voltage of said self light emitting element for display and measurement, and measuring the electrode to electrode voltage of said self light emitting element for display and measurement;

determining a cathode potential value by using a difference value between a measured value of the electrode to electrode voltage of said self light emitting element for display and measurement, and a reference voltage value as a correction value; and applying a cathode potential corresponding to the determined cathode potential value to a common cathode electrode of said self light emission type display panel.

* * * * *